US008312594B2

(12) United States Patent
Stoy et al.

(10) Patent No.: US 8,312,594 B2
(45) Date of Patent: Nov. 20, 2012

(54) CARPET CLEANING WAND HAVING UNIFORM AIR FLOW DISTRIBUTION

(75) Inventors: Michael A. Stoy, Bothel, WA (US); Nicholas Jordan, Big Harbor, WA (US); Nicholas Aadland, Kirkland, WA (US); Michael Carrol, Roy, WA (US); Jason Drexler, Covington, WA (US); Moses Boone, Palouse, WA (US)

(73) Assignee: Nilfisk-Advance, Inc., Plymouth, MN (US)

( * ) Notice: Subject to any disclaimer, the term of this patent is extended or adjusted under 35 U.S.C. 154(b) by 1079 days.

(21) Appl. No.: 12/215,704

(22) Filed: Jun. 27, 2008

(65) Prior Publication Data

US 2009/0320234 A1 Dec. 31, 2009

(51) Int. Cl.
*A47L 9/02* (2006.01)

(52) U.S. Cl. ..... 15/415.1; 15/422.1; 15/322

(58) Field of Classification Search ..... 15/321, 15/322, 325, 353, 385, 391, 401, 402, 414, 15/415, 416, 417, 418, 415.1, 422, 422.1; *A47L 9/02*
See application file for complete search history.

(56) References Cited

U.S. PATENT DOCUMENTS

| | | | | | |
|---|---|---|---|---|---|
| 963,049 | A * | 7/1910 | Kenney | 15/415.1 |
| 1,039,383 | A * | 9/1912 | Goughnour | 15/415.1 |
| 1,210,525 | A * | 1/1917 | Orr | 15/415.1 |
| 1,519,868 | A * | 12/1924 | Marshall | 15/415.1 |
| 1,951,316 | A * | 3/1934 | Allen | 15/415.1 |
| 2,283,428 | A * | 5/1942 | Ellis | 15/416 |
| 4,490,882 | A * | 1/1985 | Wells | 15/337 |
| 5,031,426 | A * | 7/1991 | Wilson | 68/207 |
| 5,537,710 | A * | 7/1996 | Selewski et al. | 15/377 |
| 5,557,822 | A * | 9/1996 | Yagi et al. | 15/369 |
| 5,867,861 | A * | 2/1999 | Kasen et al. | 15/320 |
| 5,903,955 | A * | 5/1999 | Farone et al. | 15/331 |
| 6,038,732 | A * | 3/2000 | McKnight et al. | 15/414 |
| 6,161,251 | A * | 12/2000 | Lee et al. | 15/379 |
| 6,687,952 | B1 * | 2/2004 | Mohan, Jr. | 15/353 |
| 6,742,220 | B2 * | 6/2004 | Nagai et al. | 15/401 |
| 6,842,941 | B2 * | 1/2005 | Lee | 15/385 |
| 7,308,729 | B2 * | 12/2007 | Seasholtz et al. | 15/415.1 |
| 7,409,742 | B2 * | 8/2008 | Song et al. | 15/326 |
| 7,600,291 | B2 * | 10/2009 | Choi | 15/329 |
| 7,640,626 | B2 * | 1/2010 | Oh | 15/387 |
| 7,647,671 | B2 * | 1/2010 | Yoshimura et al. | 15/334 |
| 7,694,382 | B2 * | 4/2010 | Williams et al. | 15/322 |
| 7,797,793 | B2 * | 9/2010 | Roschi et al. | 15/368 |
| 7,805,803 | B2 * | 10/2010 | Andrup et al. | 15/339 |
| 7,921,509 | B2 * | 4/2011 | Oh et al. | 15/358 |
| 2002/0092125 | A1 * | 7/2002 | Vystrcil et al. | 15/416 |
| 2002/0133903 | A1 * | 9/2002 | Vanderlinden | 15/419 |

(Continued)

*Primary Examiner* — Mark Spisich
*Assistant Examiner* — Michael Jennings
(74) *Attorney, Agent, or Firm* — Schwegman Lundberg & Woessner, P.A.

(57) ABSTRACT

A novel suction head for a carpet cleaning wand wherein either or both of two designs are utilized. Each design utilizes a generally fan shaped internal suction channel that fairs smoothly between an exhaust channel of substantially round cross section and lips of an intake opening having a much wider and substantially rectangular cross section. The internal suction channel utilized by one design is formed with a cross section that is non-uniform when viewed along the direction of air flow through the wand, which is a dramatic contrast to the uniform cross sections of known current designs. Another design utilizes an internal airfoil interrupting the internal suction channel along its centerline for diverting the air flow more towards the outside edges of the internal suction channel.

12 Claims, 24 Drawing Sheets

U.S. PATENT DOCUMENTS

2003/0140450 A1* 7/2003 Pineschi ..... 15/416
2006/0162121 A1* 7/2006 Naito et al. ..... 15/416
2006/0277713 A1* 12/2006 Sandlin et al. ..... 15/387
2009/0193615 A1* 8/2009 Nguyen ..... 15/415.1
2009/0223018 A1* 9/2009 Hong et al. ..... 15/416

* cited by examiner

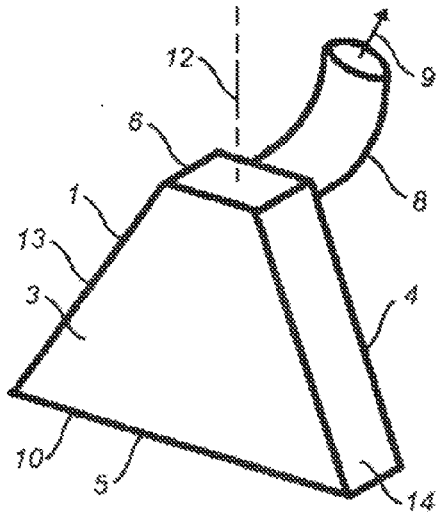
Fig. 1
(Prior Art)
Fig. 2
(Prior Art)
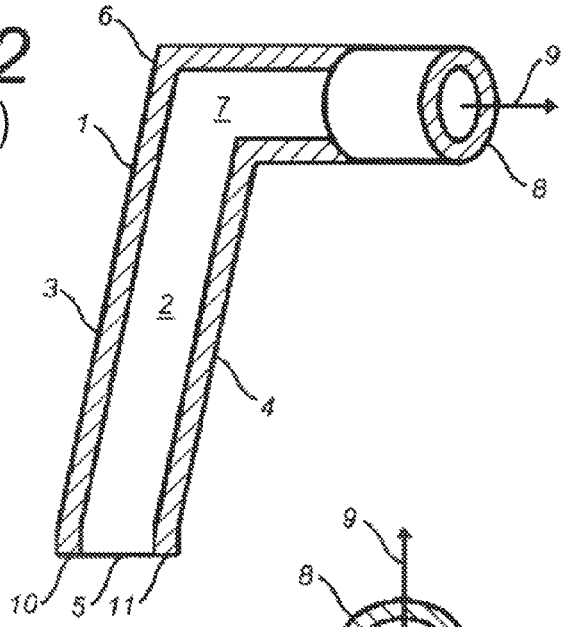
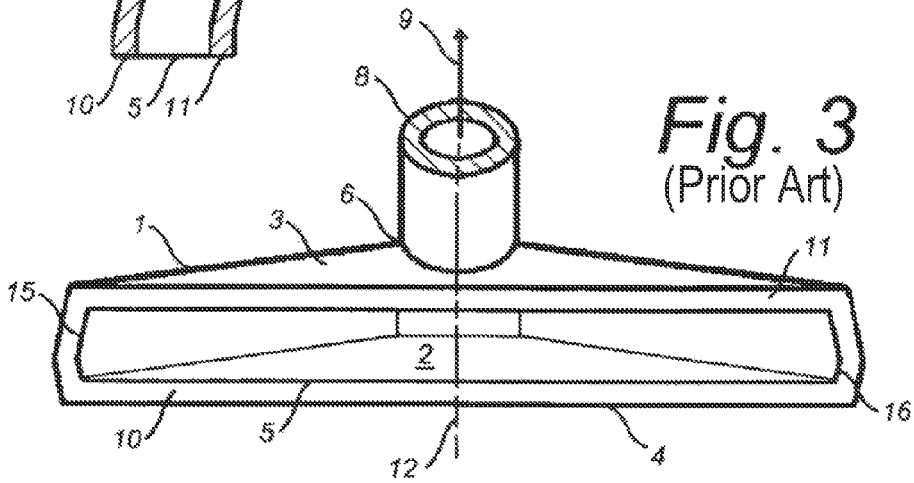
Fig. 3
(Prior Art)

| Velocity (ft/s) |
| --- |
| 300 - 375 |
| 225 - 300 |
| 150 - 225 |
| 75 - 150 |
| 0 - 75 |

| Velocity (ft/s) |
|---|
| 300 - 375 |
| 225 - 300 |
| 150 - 225 |
| 75 - 150 |
| 0 - 75 |

CARPET CLEANING WAND HAVING UNIFORM AIR FLOW DISTRIBUTION

FIELD OF THE INVENTION

The present invention relates generally to wands for carpet cleaning devices, and in particular to carpet cleaning wands having uniform air flow distribution across the lips of the opening.

BACKGROUND OF THE INVENTION

Carpet cleaning wands are generally well-known. As illustrated in FIGS. 1, 2 and 3, such known carpet cleaning wands have a suction head 1 formed internally with an elongated hollow suction channel 2 which extends between substantially parallel spaced apart front and back surfaces 3 and 4 to an intake opening 5 that is applied to the surface to be cleaned. A hood may be provided to cover the suction head 1. The suction head 1 is coupled having the internal suction channel 2 terminating at its apex 6 in a portal 7. The portal 7 is in communication with a tubular conduit 8 directed rearwardly of the suction head 1. In operation, portal 7 is connected through the conduit 8 to a suction-generator unit which is conventional in the art of vacuum cleaners and thus has been omitted from the drawing. Such unit draws air successively through the intake opening 5, the suction channel 2, the portal 7 and conduit 8, the direction of air flow being indicated by arrow 9.

The suction head 1 and internal suction channel 2 are typically formed having a generally triangular "fan" shape with a substantially constant cross section between the substantially parallel front and back surfaces 3, 4. The conduit 8 is connected at the apex 6 of the fan-shaped suction channel 2. The hollow fan-shaped suction channel 2 may be curved or relatively flat with the intake opening 5 formed along the fan base. The suction intake opening 5 extends across the width of the suction head 1 and is typically formed as an elongated slot bounded by narrowly spaced lips 10 and 11. Typically, the narrowly spaced lips 10, 11 are substantially straight and parallel. Often the lips 10, 11 of the slot-shaped suction intake opening 5, specifically the trailing lip 11 as considered with reference to the direction of travel of the suction head 1 relative to the object to be cleaned, is formed with a shear edge 11 which enhances the cleaning effect. Thus, in keeping with accepted wisdom, the current state of the art provides a clear flow path through the internal suction channel 2 in order to maximize air flow by providing a substantially unrestricted flow path between the lips 10, 11 of the suction intake opening 5 and the portal 7 to the tubular conduit 8.

However, known carpet cleaning wands having a clear flow path through the internal suction channel 2 also have a very non-uniform flow velocity across the width of the lips 10, 11 of the intake opening 5 that contact the carpet. This non-uniform flow velocity is illustrated in FIG. 4 by means of a heuristic chart of flow velocity through the suction head's internal suction channel 2. As illustrated here, the flow velocity is a maximum in the conduit 8 leading to the suction-generator unit, and in the internal suction channel 2 adjacent to the portal 7. The flow velocity rapidly dwindles in the suction channel 2 as it fans out from the apex 6 toward the intake opening 5. While dwindling overall, the flow velocity remains highest near the centerline 12 of the internal suction channel 2. Toward the intake opening 5 from the apex 6, the flow velocity decays non-uniformly across the suction channel 2, remaining highest near the centerline 12 and falling off toward opposite sides 13 and 14 of the internal suction channel 2. The flow velocity away from the centerline 12 continues to degrade toward the intake opening 5, and decays to near zero adjacent to the far sides 13, 14 approaching the intake opening 5. The flow velocity is thus extremely non-uniform across the width of the intake opening lips 10, 11, being at a maximum near the centerline 12 and falling off rapidly away from the centerline 12 to near zero nearer to opposite ends 15 and 16 of the intake opening 5 adjacent to the sides 13, 14.

This non-uniform flow velocity across the lips of known carpet cleaning wands results in uneven cleaning and streaking. Known carpet cleaning wands are thus limited in their ability to provide uniform and streak-free cleaning.

SUMMARY OF THE INVENTION

The present invention is a novel suction head for a carpet cleaning wand. Two designs are disclosed for the novel suction head. Each design utilizes a generally fan shaped internal suction channel that fairs smoothly between an exhaust channel of substantially round cross section and lips of an intake opening having a much wider and substantially rectangular cross section. The internal suction channel utilized by one design is formed with a cross section that is non-uniform when viewed along the direction of air flow through the wand, which is a dramatic contrast to the uniform cross sections of known current designs. According to this design, the non-uniform cross section of the internal suction channel increases in area towards the outside edges of the wand. This increasing area reduces the resistance to air flow towards the outside edges of the suction channel, which produces dramatically more uniform air flow distribution at the lips than was known in the prior art. According to different versions of this design, the non-uniform cross section of the internal suction channel is either limited to an upper suction channel portion of the internal suction channel, or else extends through to the lips of the intake opening of the suction head that is applied to the surface to be cleaned.

The second design is formed with a smooth walled internal airfoil oriented along the direction of air flow and interrupting the upper suction channel portion of the generally fan shaped internal suction channel substantially symmetrically along its centerline. This airfoil section diverts the air flow more towards the outside edges of the internal suction channel. The airfoil section is spaced a short distance back from the lips, which allows space for the air flow to equalize and again result in a more uniform air flow distribution at the lips than was known in the prior art.

Both designs for the novel suction head go against the accepted wisdom known in the current state of the art that provides a clear flow path through the internal suction channel. Both designs are counterintuitive since they utilize structure for interrupting the suction channel instead of keeping it open and unobstructed as is the accepted wisdom as practiced in the current state of the art. The non-uniform cross section design utilizes a relatively narrow channel along the centerline of the generally fan shaped internal suction channel for connecting a pair of substantially symmetric elongated ovoids. The narrow connecting channel effectively closes the center of the internal suction channel and significantly restricts air flow to the ovoid portions it connects. Furthermore, the ovoid portions themselves are narrower near the center of the internal suction channel and enlarge significantly away from the centerline toward the suction channel's extreme lateral wall surfaces.

The internal airfoil design interrupts the internal suction channel right along its centerline and diverts air flow towards the outside edges of the internal suction channel. The internal airfoil thus also effectively closes the center of the internal suction channel before allowing space for the air flow to equalize nearer the lips of the intake opening.

Another design includes the non-uniform cross section of the internal suction channel in combination with the internal airfoil along its centerline. This design utilizes the internal airfoil to interrupt the internal suction channel along its centerline and divert air flow towards its outside edges, while utilizing the pair of substantially symmetric elongated ovoids to increase flow area and gradually decrease flow resistance towards the outside edges of the wand. This combination of the two designs produces the most uniform air flow distribution at the lips of the intake opening.

Therefore, according to one aspect of the novel suction head for a carpet cleaning wand, the suction head includes a substantially rigid conduit formed with an exhaust channel therein. A substantially rigid body is formed with a crown portion coupled to the conduit, and an intake opening that is formed between a pair of spaced apart lips adjacent to a foot portion of the body. A generally fan shaped suction channel is formed internal of the body and extended between the intake opening thereof and the exhaust channel of the conduit, the suction channel has a non-uniform cross section transverse of a flow path between the intake opening and the exhaust channel that increases in cross-sectional area substantially symmetrically outwardly from a central portion thereof.

According to another aspect of the novel suction head for a carpet cleaning wand, the non-uniform transverse cross section of the internal suction channel further fairs smoothly into fluid communication with both the intake opening of the body and the exhaust channel of the conduit.

According to another aspect of the novel suction head for a carpet cleaning wand, the central portion of the non-uniform transverse cross section of the internal suction channel further includes a transverse connecting channel that is smoothly faired between portions of the internal suction channel that increase in area substantially symmetrically outwardly from the transverse connecting channel.

According to another aspect of the novel suction head for a carpet cleaning wand, the portions of the non-uniform transverse cross section of the internal suction channel that substantially symmetrically increase in area outwardly from the transverse connecting channel are each further formed as ovoid sections elongated outwardly from the transverse connecting channel.

According to another aspect of the novel suction head for a carpet cleaning wand, the non-uniform transverse cross section of the internal suction channel further includes a first pair of surfaces that curve outwardly from the transverse connecting channel and smoothly fair into a respective one of the ovoid sections elongated outwardly therefrom.

According to another aspect of the novel suction head for a carpet cleaning wand, the non-uniform transverse cross section is further formed substantially symmetrically about an axis of the connecting channel that is oriented substantially transverse of the internal suction channel.

According to another aspect of the novel suction head for a carpet cleaning wand, the internal suction channel is further formed with a first curved portion adjacent to the exhaust channel of the conduit, the first curved portion being in fluid communication with the exhaust channel and is further partially extended toward the intake opening of the body.

According to another aspect of the novel suction head for a carpet cleaning wand, the internal suction channel is further formed with a curved throat portion that is in fluid communication between the first curved portion of the internal suction channel and the intake opening of the body. Furthermore, the throat portion is curved substantially oppositely of the first curved portion.

According to another aspect of the novel suction head for a carpet cleaning wand, the non-uniform transverse cross section further extends substantially through the curved neck portion of the internal suction channel.

According to another aspect of the novel suction head for a carpet cleaning wand, the non-uniform transverse cross section further extends substantially through the curved neck portion.

According to another aspect of the novel suction head for a carpet cleaning wand, the non-uniform transverse cross section further extends substantially through the intake opening of the body.

According to another aspect of the novel suction head for a carpet cleaning wand, the internal suction channel is further formed with an internal airfoil substantially interrupting the non-uniform transverse cross section substantially along a centerline thereof. Furthermore, the airfoil is an elongated teardrop shaped surface positioned within the internal suction channel and substantially oriented along the direction of air flow between the intake opening of the body and the exhaust channel of the conduit. The airfoil forms a substantially closed surface positioned within the internal suction channel, the substantially closed surface of the airfoil having a wide, convexly curved leading surface portion spaced away from the intake opening of the body, and a pair of slightly convexly curved opposing side surface portions symmetrically extended from the convexly curved leading surface portion and tapering toward the exhaust channel of the conduit and meeting in a substantially smooth joint adjacent thereto. The wide, convexly curved leading surface portion of the airfoil facing toward the air flow through the intake opening of the body avoids snagging of debris, particularly stranded debris such as hair, string, yarn or thread, that may be sucked through the intake opening. The wide, convexly curved leading surface portion of the airfoil thus substantially eliminates clogging of the internal suction channel due to potential trapping of such debris.

Other aspects of the invention are detailed herein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 1 is a pictorial view showing an example of the carpet cleaning wands of the prior art;

FIG. 2 is a cross section view through the exemplary carpet cleaning wand of FIG. 1;

FIG. 3 is a bottom view of the suction intake opening of the exemplary carpet cleaning wand of FIG. 1;

FIGS. 6 through 12 illustrate detail views of the novel suction head for a carpet cleaning wand as illustrated pictorially in FIG. 5, wherein FIG. 6 is a front view of the novel carpet cleaning wand, FIG. 7 is a top view, FIG. 8 is a bottom view, FIG. 9 is a left side view showing internal contours of the non-uniform cross section of the suction channel, FIG. 10 is a cross section view showing a narrow connecting channel portion of the non-uniform suction channel along a centerline thereof, FIG. 11 is a different cross section view showing a wide portion of the non-uniform suction channel spaced away from the centerline thereof, and FIG. 12 is a cross section view showing contours of the non-uniform internal suction channel;

FIGS. 14 through 20 illustrate detail views of the alternative novel suction head for a carpet cleaning wand as illustrated pictorially in FIG. 14, wherein FIG. 15 is a front view of the alternative novel carpet cleaning wand, FIG. 16 is a top view, FIG. 17 is a bottom view, FIG. 18 is a left side view showing internal contours of the non-uniform cross section of the suction channel, FIG. 19 is a cross section view showing a narrow connecting channel portion of the non-uniform suction channel along a centerline thereof, FIG. 20 is a different cross section view showing a wide portion of the non-uniform suction channel spaced away from the centerline thereof.

FIGS. 23 through 29 illustrate detail views of the alternative novel suction head for a carpet cleaning wand as illustrated pictorially in FIG. 22, wherein FIG. 23 is a front view of the alternative novel carpet cleaning wand, FIG. 24 is a top view, FIG. 25 is a bottom view, FIG. 26 is a left side view showing internal contours of the substantially uniform cross section of the suction channel interrupted by the airfoil, FIG. 27 is a cross section view showing the airfoil interrupting the substantially uniform suction channel along a centerline thereof, FIG. 28 is a different cross section view showing a portion of the substantially uniform suction channel spaced away from the centerline thereof and the airfoil formed there along, and FIG. 29 is a cross section view showing contours of the substantially uniform internal suction channel interrupted by the airfoil;

FIGS. 32 through 38 illustrate detail views of the alternative novel suction head for a carpet cleaning wand as illustrated pictorially in FIG. 31, wherein FIG. 32 is a front view of the novel carpet cleaning wand, FIG. 33 is a top view, FIG. 34 is a bottom view, FIG. 35 is a left side view showing internal contours of the non-uniform cross section of the suction channel interrupted by the airfoil, FIG. 36 is a cross section view showing the narrow connecting channel portion of the non-uniform suction channel along a centerline thereof as interrupted by the airfoil, FIG. 37 is a different cross section view showing a wide portion of the non-uniform suction channel spaced away from the centerline thereof, and FIG. 38 is a cross section view showing contours of the non-uniform internal suction channel.

DETAILED DESCRIPTION OF PREFERRED EMBODIMENT

In the Figures, like numerals indicate like elements.

Figure 5:
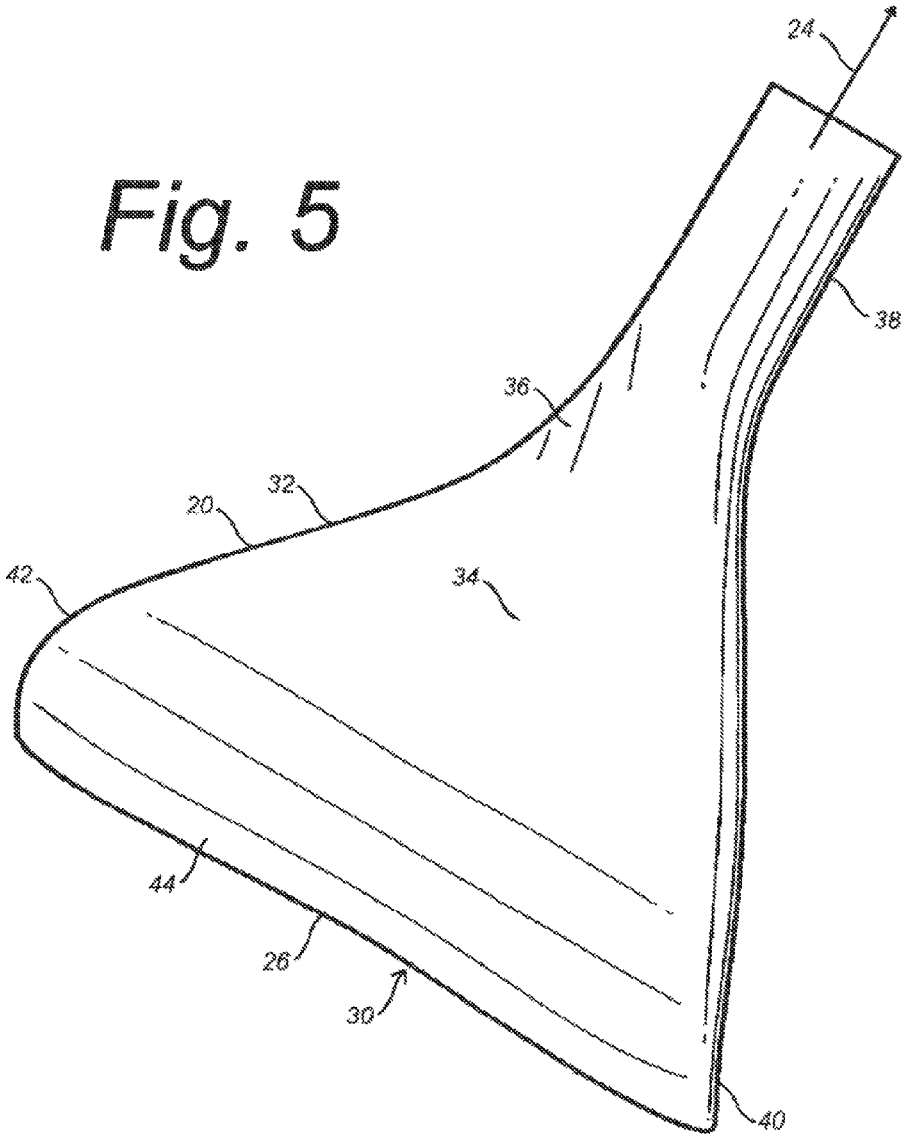
FIG. 5 is a pictorial view that illustrates one novel suction head for a carpet cleaning wand, wherein a novel suction channel formed with a non-uniform cross section across the direction of air flow that produces dramatically more uniform flow distribution across lips of an intake opening thereinto.

FIG. 5 is a pictorial view that illustrates one novel suction head 20 for a carpet cleaning wand, wherein a novel internal suction channel 22 (illustrated in subsequent figures) is formed within the novel suction head 20. The novel internal suction channel 22 is formed with a novel non-uniform cross section across the direction of air flow (indicated by arrow 24). The novel non-uniform cross section of the internal suction channel 22 produces dramatically more uniform flow distribution across lips 26 and 28 of an intake opening 30 that communicates with the suction channel 22. By example and without limitation, the suction head 20 is formed with a generally fan shaped body 32 having a slightly inversely arched or "swaybacked" upper body portion 34 communicating at its upper crown 36 with a with a tubular conduit 38 which is led to a suction-generator unit of a type disclosed in the prior art. The inversely arched upper body portion 34 communicates at its lower end with a wide foot portion 40. A curved neck portion 42 gently rotates the foot portion 40 of the fan shaped body 32 away from the slightly inversely arched upper portion 34. The wide foot portion 40 terminates in a generally straight skirt portion 44, which terminates in the lips 26, 28 of the intake opening 30 that is applied to the surface to be cleaned.

It is to be noted that the body 32 is shown by example and without limitation as being generally fan shaped and having the crown 36, inversely arched upper body portion 34, generally straight skirt portion 44 and curved neck portion 42 gently rotating the foot portion 40 of the fan shaped body 32 away from the slightly inversely arched upper portion 34. It will be understood by the following description that another shape of the body 32 would be similarly effective in practicing the invention because the novel suction channel 22 is determinative of the substantially uniform flow velocity through the body 32. Therefore, be it known that one or more other shapes of the body 32 are also contemplated and may be substituted without deviating from the scope and intent of the present invention.

Figure 6:
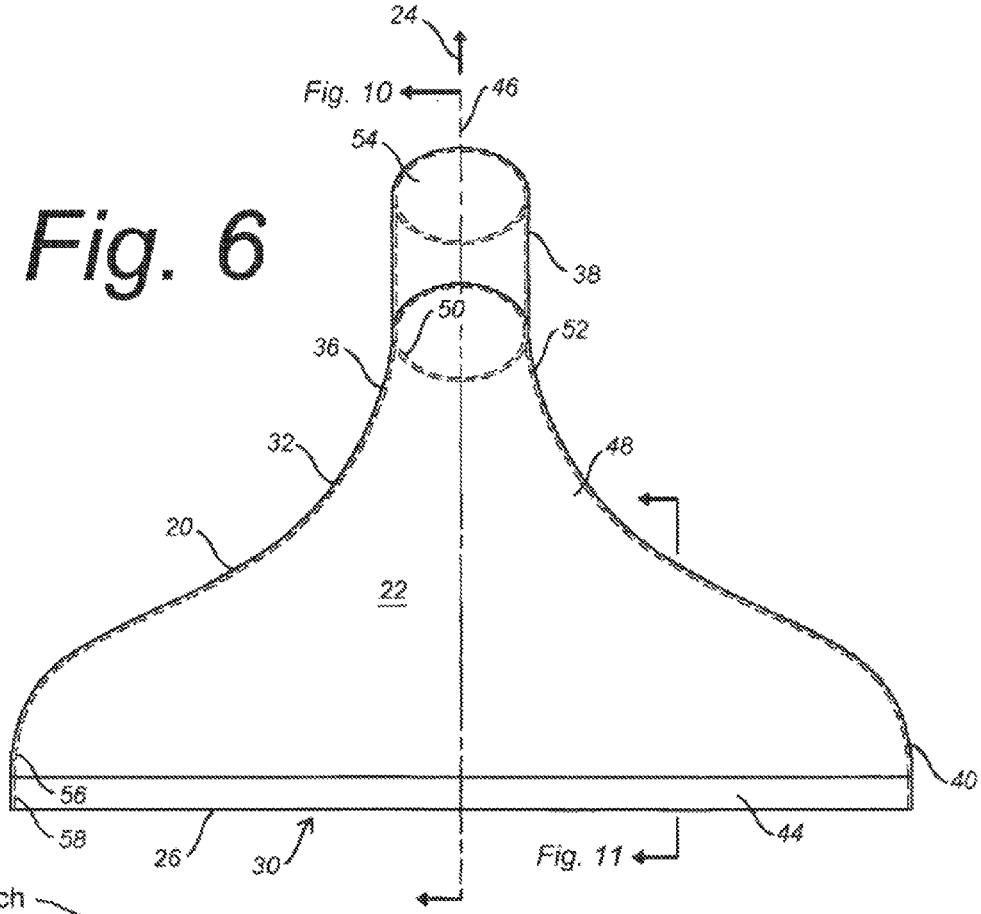

FIGS. 6 through 11 illustrate detail views of the novel suction head 20 for a carpet cleaning wand as illustrated pictorially in FIG. 5. The front view of FIG. 6 shows the suction head 20 and novel suction channel 22 (dashed lines) formed internally thereof. Here, both the generally fan shaped body 32 and internal suction channel 22 of the suction head 20 are more clearly shown as being substantially symmetric about a common centerline 46. As more clearly illustrated in subsequent figures, the novel suction channel 22 is contoured as a generally fan shaped channel having substantially smooth-walls throughout. The novel generally fan shaped suction channel 22 is formed with a slightly arched upper suction channel portion 48 having a smooth-walled outlet 50 at its upper apex 52 that is smoothly faired into fluid communication with a smooth-walled and substantially cylindrical exhaust channel 54 of the tubular conduit 38 which is led to the suction-generator unit.

Opposite from its outlet 50 at the apex 52 thereof, the substantially smooth-walled upper suction channel portion 48 is smoothly faired into fluid communication with a wide and substantially smooth-walled base portion 56 of the fan shaped internal suction channel 22. The base portion 56 of the fan shaped suction channel 22 is firmed with a generally straight terminal skirt portion 58 in fluid communication with the slightly arched upper suction channel portion 48. The terminal skirt portion 58 of the internal suction channel 22 is in fluid communication with the intake opening 30 between the terminal lips 26, 28, which places the slightly arched upper portion 48 in fluid communication therewith.

Figure 7:
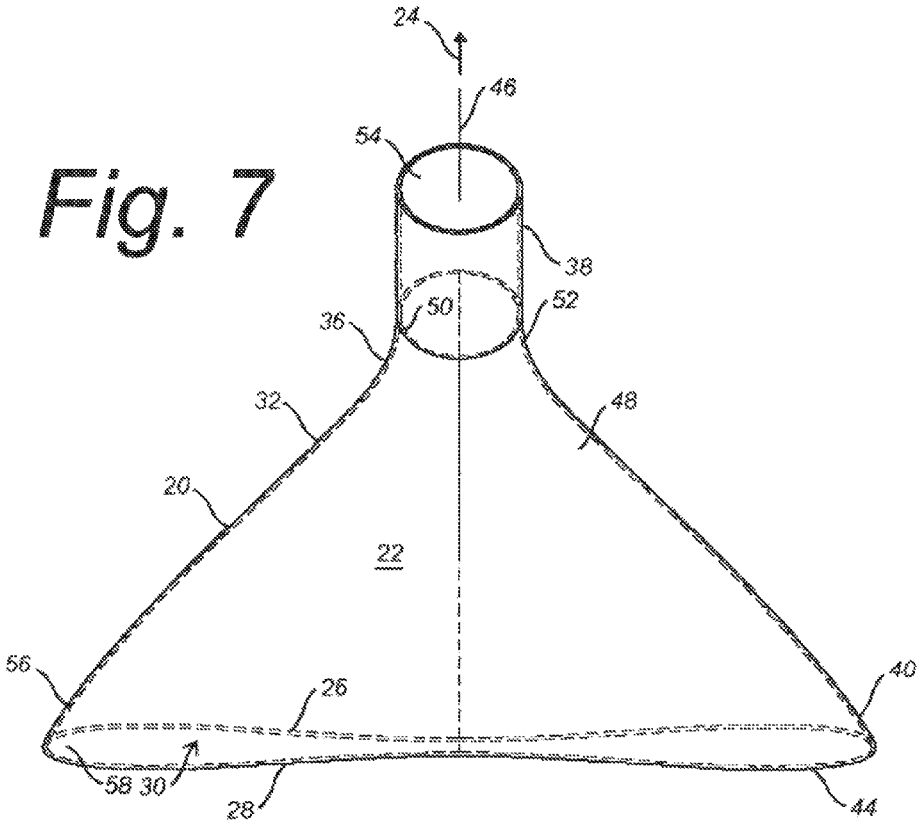

The top view of FIG. 7 also shows the body 32 and internal suction channel 22 (dashed lines) of the suction head 20 being substantially symmetric about their common centerline 46. FIG. 7 also shows the body 32 of suction head 20 being generally fan shaped. As more clearly shown here, the general fan shape of the body 32 extends from the crown 36 through the arched upper body portion 34 and curved neck portion 42 into the wide foot portion 40 and skirt portion 44, and terminates in the intake opening 30 (dashed lines). The intake opening 30 is illustrated here as having the non-uniform shape across the direction of air flow (arrow 24) being carried through from the non-uniform cross section of the suction channel 22.

As also shown here, the upper suction channel portion 48 of the internal suction channel 22 is smoothly faired into the substantially cylindrical exhaust channel 54 of the tubular conduit 38. Furthermore, the general fan shape of the internal suction channel 22 is shown to extend smooth-walled from its outlet 50 at the upper apex 52 through the slightly arched upper suction channel portion 48 and terminal skirt portion 58 of the base portion 56, which terminates in the intake opening 30.

Figure 8:
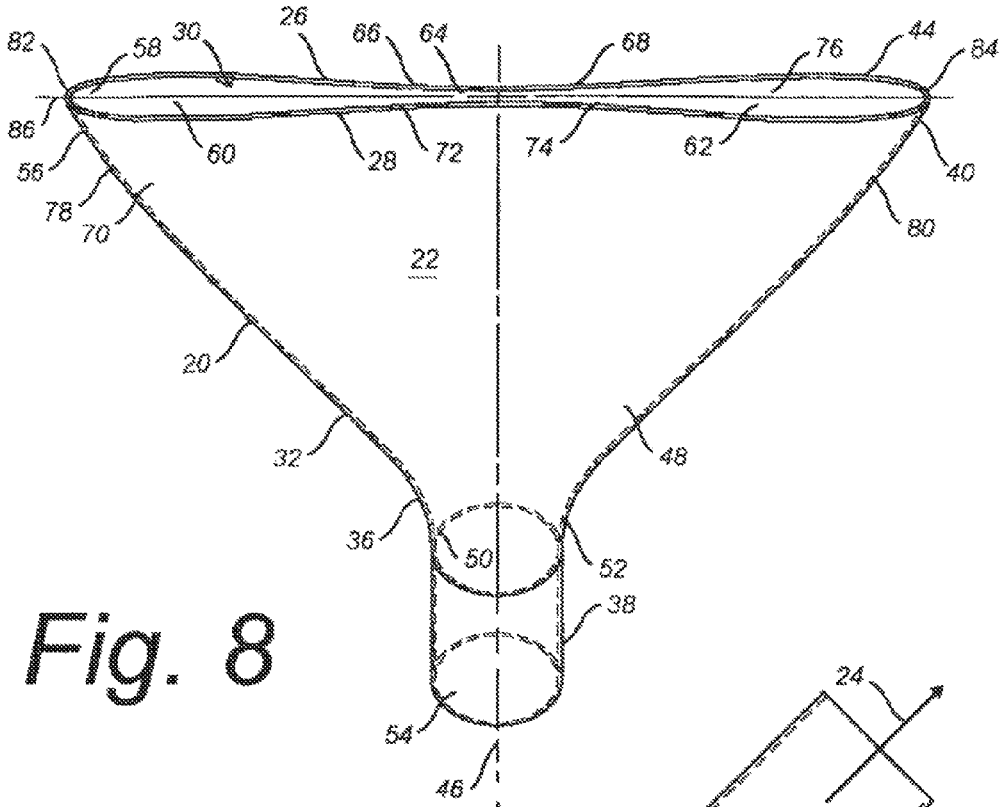

The bottom view of FIG. 8 also shows the symmetry about common centerline 46 of the body 32 and internal suction channel 22 (dashed lines) of the suction head 20. Furthermore, the intake opening 30 is illustrated here as having the non-uniform shape across the direction of air flow (arrow 24) being carried through from the non-uniform cross section of the suction channel 22. The non-uniform shape of the intake opening 30 and the internal suction channel 22 are more clearly shown here as being formed of a substantially continuous curve that is shaped substantially as a "dog bone" or an elongated figure "8" having a pair of substantially symmetric oval portions 60 and 62 each elongated toward the centerline 46 and becoming relatively wider outwardly thereof. The elongated ovoids 60, 62 communicate through a relatively narrow transverse connecting channel 64 spanning the centerline 46. The elongated ovoids 60, 62 and narrow connecting channel 64 are continuously conjoined through a first pair of gently outwardly curving wall surfaces 66 and 68 on a first or front wall surface 70 of the internal suction channel 22, and a second pair of gently oppositely outwardly curving wall surfaces 72 and 74 on a second or back surface 76 thereof that substantially mirror the first pair of gently outwardly curving wall surfaces 66, 68. The non-uniform intake opening 30 and internal suction channel 22 thus gently increase in area outwardly of the centerline 46 toward opposing extreme lateral wall surfaces 78 and 80 commensurate with lateral portions 82 and 84 of the lips 26, 28 of the terminal inlet opening 30 and contiguous therewith. The elongated ovoids 60, 62 and narrow connecting channel 64 of the non-uniform cross section are shown here for the internal suction channel 22 and the intake opening 30 thereinto. Furthermore, the non-uniform cross section of the internal suction channel 22 is extended through the generally fan shaped body 32 from the intake opening 30 toward its outlet 50 into the substantially cylindrical exhaust channel 54 through the tubular conduit 38. The body 32 and internal suction channel 22 thus each have a novel double barrel appearance formed substantially symmetrically about an axis 86 transverse of their common centerline 46 and the direction of air flow (arrow 24) as may be achieved, for example, by partially flattening a cone or funnel. The resultant continuous non-uniform cross section of the suction channel 22 and intake opening 30 reduces resistance to fluid flow towards the lateral wall surfaces 78, 80 of the internal suction channel 22, which produces dramatically more uniform flow distribution across the lips 26, 28 of intake opening 30 than was possible in the prior art.

Figure 9:
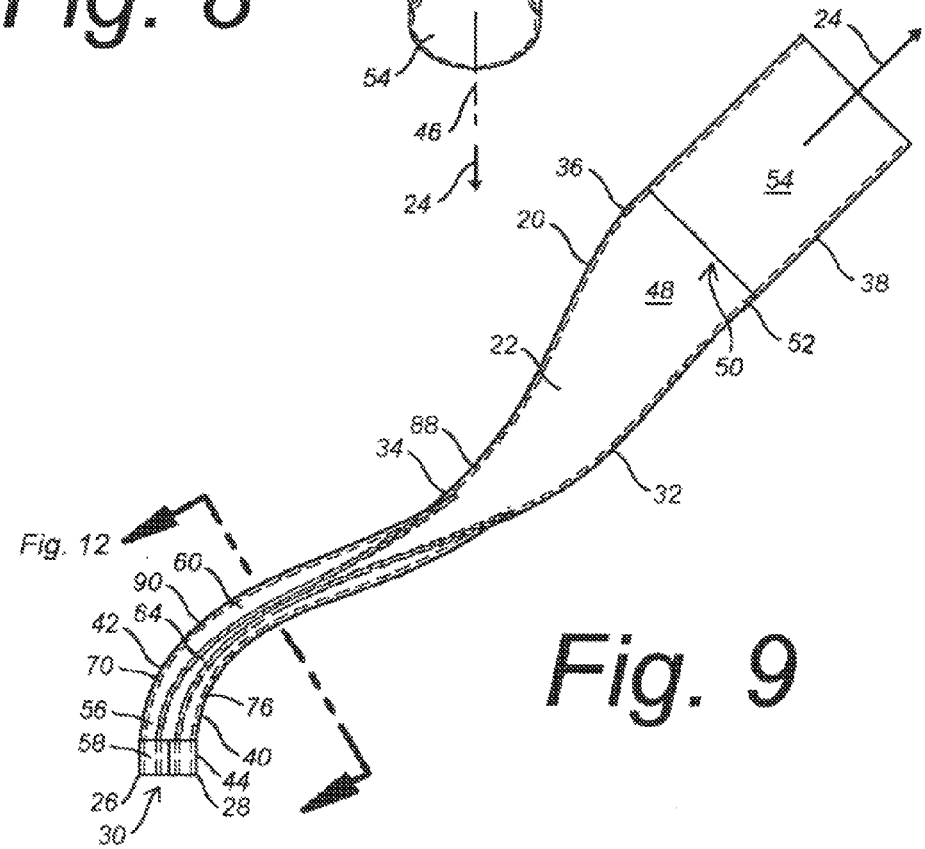

The side view of FIG. 9 shows the partially flattened cone or funnel shape of the body 32 and internal suction channel 22 (dashed lines) of the suction head 20. The suction head 20 is shown here having the generally fan shaped body 32 formed with the slightly "swaybacked" upper body portion 34 having the inverse arch and communicating at its upper crown 36 with the tubular conduit 38. The neck portion 42 of the fan shaped body 32 is shown gently curving out of the inversely arched portion 34 and into the wide foot portion 40 for gently rotating the generally straight skirt portion 44 away from the slightly inversely arched upper portion 34. The terminal skirt portion 44 of the fan shaped body 32 is shown as terminating in the intake opening 30 that is applied to the surface to be cleaned.

The dashed lines show the novel internal suction channel 22 within the suction head 20 being of variable or non-uniform cross section across the direction of air flow (arrow 24) having the narrow connecting channel 64 spanning the centerline 46 between the pair of elongated ovoids 60, 62. The novel internal suction channel 22 is thus commensurate with the terminal inlet opening 30 and contiguous with the lips 26, 28 thereof.

The dashed lines also show the slightly arched upper suction channel portion 48 of the fan shaped channel 22 being formed with a slightly inversely bow curved arch 88 that is smoothly faired into fluid communication with the substantially cylindrical exhaust channel of the tubular conduit 38. As shown here by example and without limitation, the inversely curved arch 88 is substantially commensurate with the slightly inversely arched upper portion 34 of the fan shaped body 32. Additionally, the dashed lines show the base portion 56 of the fan shaped channel 22 formed with a gently curving throat portion 90 leading out of the inversely curved arch 88 of the upper suction channel portion 48 and faring smoothly into the generally straight terminal skirt portion 58 of the base portion 56. The curved throat portion 90 of the internal suction channel 22 gently rotates the terminal skirt portion 58 back in the general convex direction of the inversely curved arch 88. The curved throat portion 90 gently rotates the terminal skirt portion 58 about 45 degrees, or in the range of about 30 to 75 degrees, away from the inversely curved arch 88 of the upper suction channel portion 48.

Figure 10:
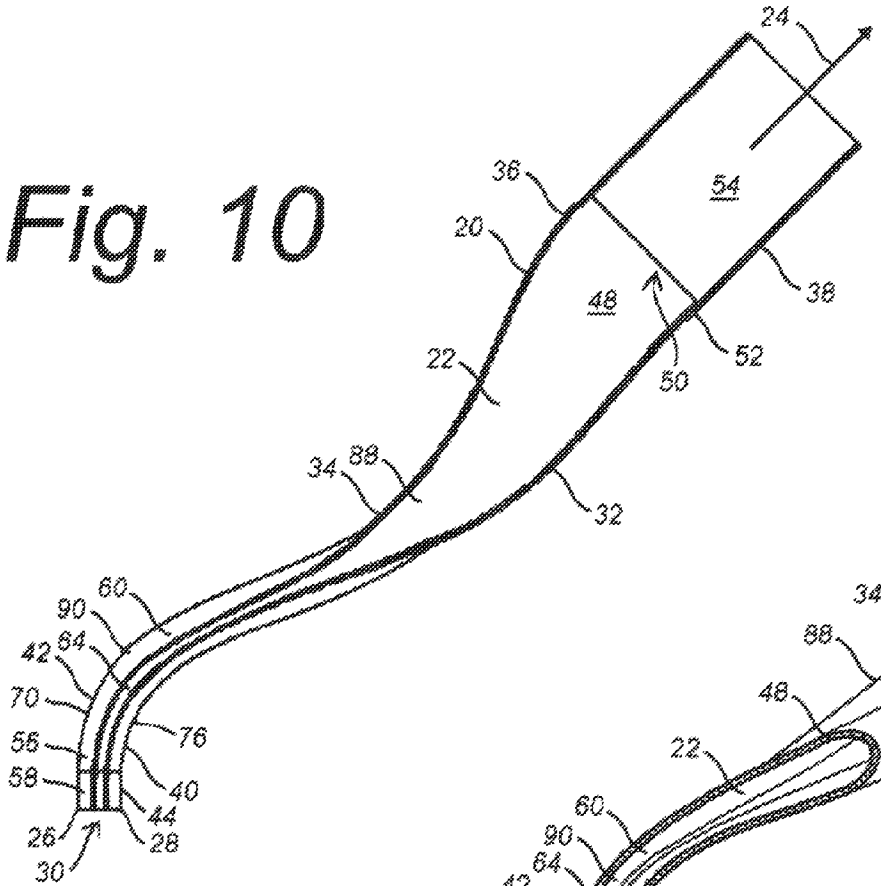

The cross section view of FIG. 10 is taken along the centerline 46 of the suction head 20. FIG. 10 shows the narrow connecting channel 64 spanning the centerline 46 and communicating between the pair of elongated ovoids 60, 62 of the non-uniform internal suction channel 22 formed therein and extending into the non-uniform intake opening 30 in fluid communication therewith.

Figure 11:
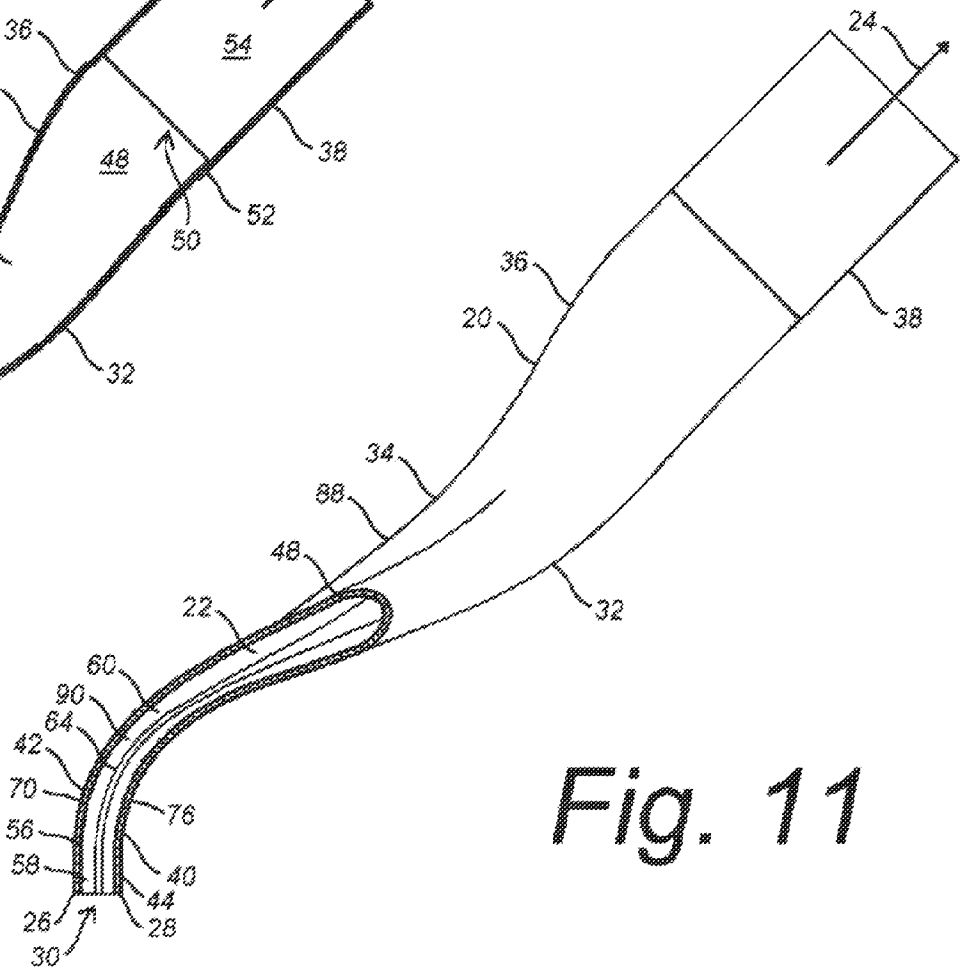

The cross section view of FIG. 11 is taken parallel to the centerline 46 of the suction head 20 through the nearer one of the pair of elongated oval portions 60, 62 of the non-uniform internal suction channel 22. As illustrated, the general fan shape of the internal suction channel 22 causes the oval portions 60, 62 to taper into the generally tubular shape of the outlet 50 at the upper apex 52 and the crown 36 of the generally fan shaped body 32.

Figure 12:
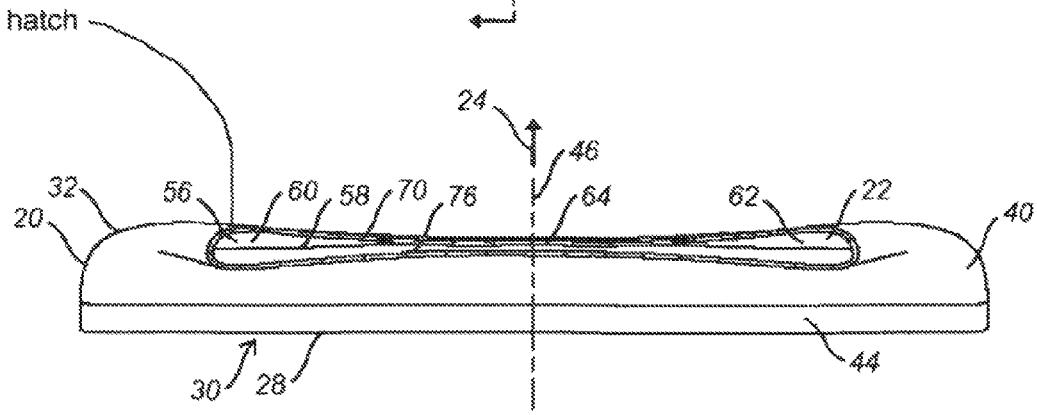

FIG. 12 is a cross section view through the novel suction head 20 of FIG. 5 and the non-uniform internal suction channel 22 taken transversely of the common centerline 46. Here, the novel double barrel appearance of the internal suction channel 22 is shown to continue from the intake opening 30 in substantial symmetry about the centerline 46 toward its outlet 50 at the upper apex 52.

Figure 13:
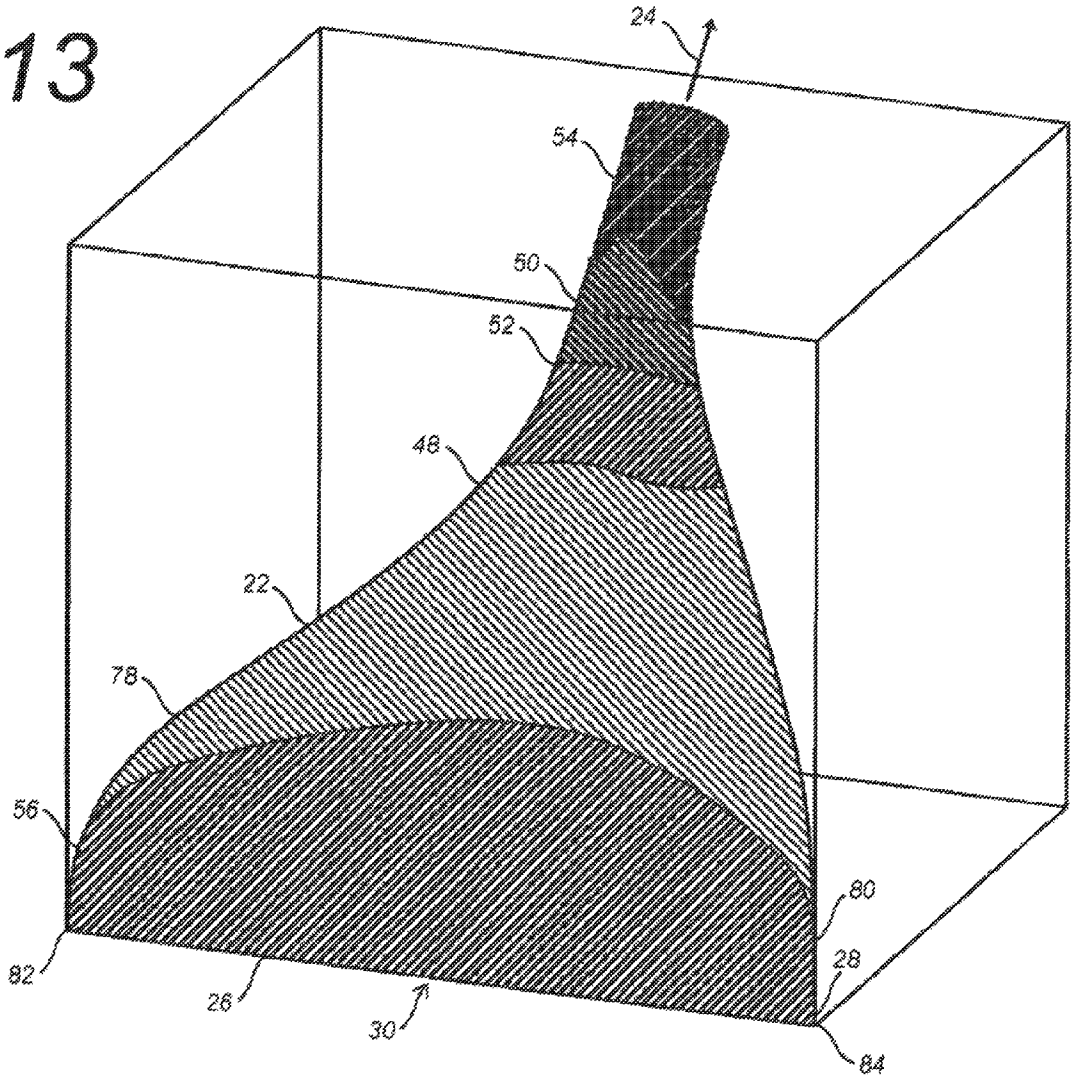
FIG. 13 is a heuristic chart illustrating flow velocity through the non-uniform cross section of the suction channel of the novel carpet cleaning wand illustrated in FIGS. 5 through 12.

FIG. 13 illustrates the substantially uniform flow velocity through the non-uniform cross section of the suction channel 22 of the novel carpet cleaning suction head 20 illustrated in FIGS. 5 through 12. As illustrated here, the substantially uniform flow velocity across the width of the intake opening lips 26, 28 of the intake opening 30 that is applied to the surface to be cleaned is determined by the novel shape of the non-uniform internal suction channel 22 extended through the body 32.

Figure 4:
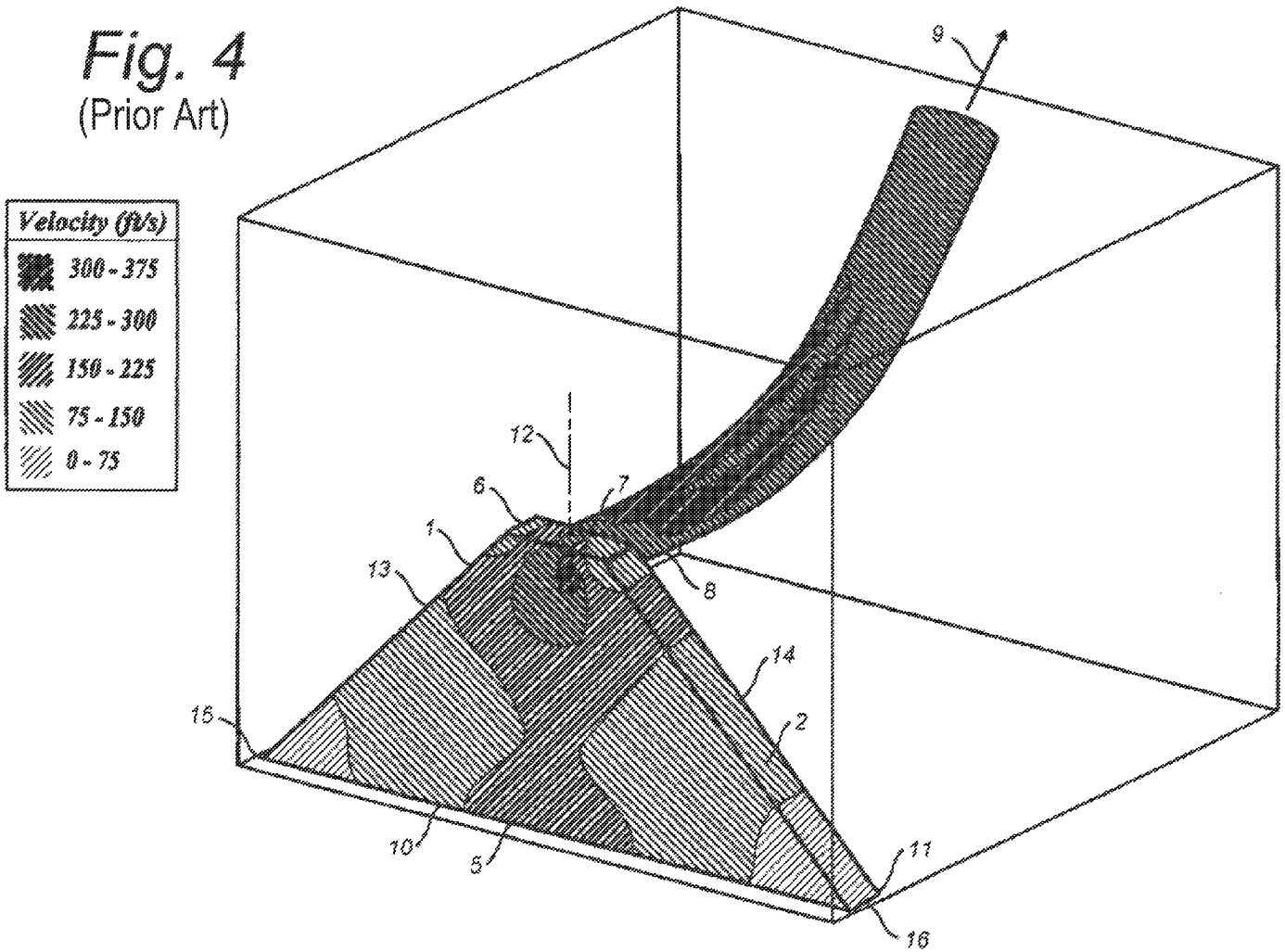
Fig. 4 (Prior Art)
FIG. 4 is a heuristic chart illustrating flow velocity through the internal suction channel of the prior art suction head.

As illustrated here, the flow velocity is a maximum in the exhaust channel 54 of the tubular conduit 38 leading to the suction-generator unit, and slowing slightly in the upper apex 52 of the internal suction channel 22 adjacent to the smooth-walled outlet 50. The flow velocity is reduced in the arched upper suction channel portion 48 of the suction channel 22 as it fans out from the apex 52. However, while slowing slightly more in the upper suction channel portion 48, the flow velocity remains substantially uniform across the non-uniform shape of the suction channel 22 as it continues to fan out toward the opposing extreme lateral wall surfaces 78, 80 of the suction channel 22. Furthermore, the flow velocity in the suction channel 22 actually increases past the upper suction channel portion 48 approaching the smooth-walled base portion 56 toward the intake opening 30. The non-uniform cross section of the internal suction channel 22 generated by the elongated ovoids 60, 62 and narrow connecting channel 64 thus force the flow velocity to be extremely uniform across the entire width of the suction channel 22 between the opposing extreme lateral wall surfaces 78, 80 as it fans out toward the opposing lips 26, 28 of the intake opening 30. The flow velocity remains substantially uniform across substantially the entire width of the intake opening 30 from the narrow connecting channel 64 of the non-uniform cross section through the elongated ovoids 60, 62 to the extreme lateral portions 82, 84 of the lips 26, 28. Additionally, the substantially uniform flow velocity across substantially the entire width of the intake opening 30 is in the same range as the maximum flow velocity attained near the centerline 12 of the intake opening 5 for the internal suction channel 2 of the prior art suction head 1, as illustrated in FIG. 4, but does not falling off away from the centerline 46 as occurs in the prior art suction head 1 around its centerline 12.

Figure 14:
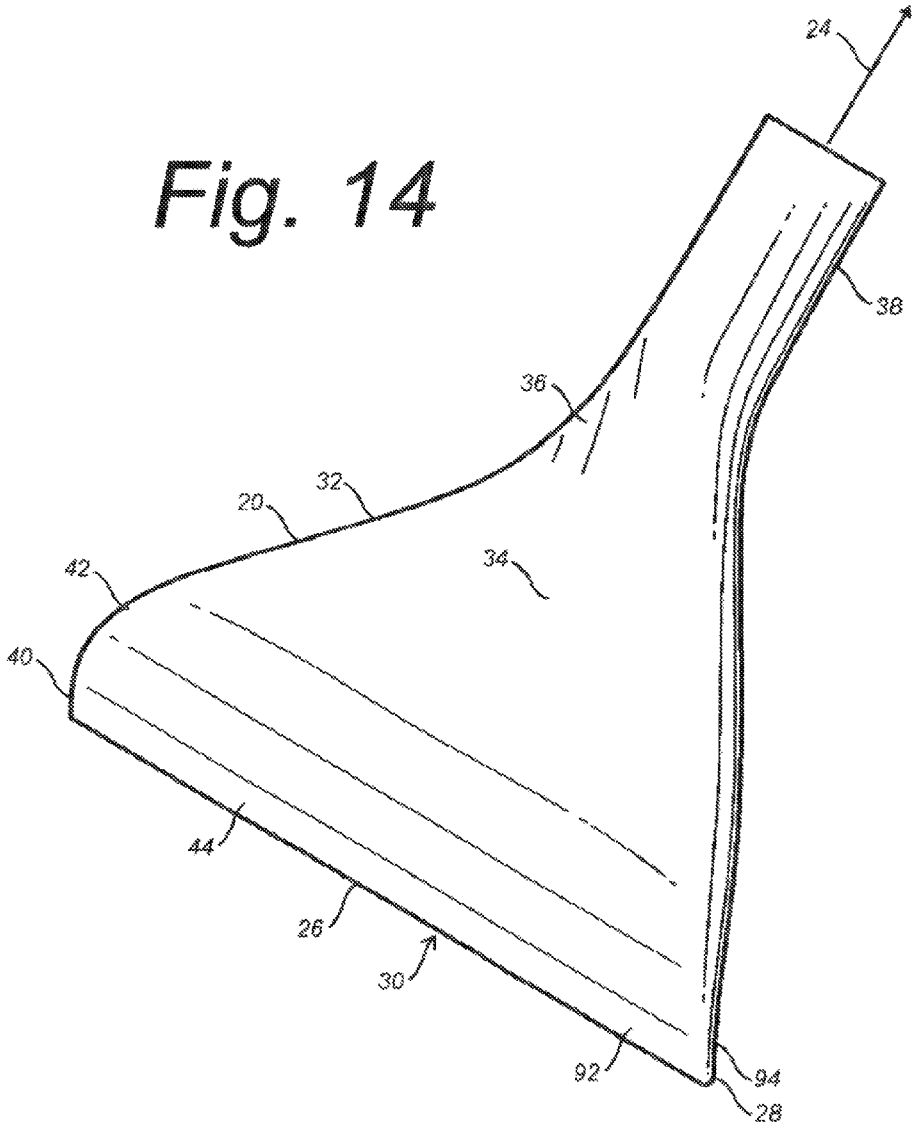
FIG. 14 is a pictorial view that illustrates an alternative novel suction head for a carpet cleaning wand, wherein an alternative suction channel is formed with a shorter version of the non-uniform cross section across the direction of air flow that produces dramatically more uniform flow distribution across lips of an intake opening thereinto.

FIG. 14 is a pictorial view that illustrates an alternative embodiment of the novel suction head 20 for a carpet cleaning wand, wherein the generally fan shaped body 32 is formed having the terminal lips 26, 28 being spaced apart by a substantially constant distance along the intake opening 30. Additionally, the novel internal suction channel 22 (illustrated in subsequent figures) formed within the suction head 20 is formed with the novel non-uniform cross section for only a short portion thereof across the direction of air flow (indicated by arrow 24).

The novel non-uniform cross section of the suction channel 22 having the shortened non-uniform cross section also produces dramatically more uniform flow distribution across the substantially constantly spaced apart lips 26, 28 of an intake opening 30 that communicates with the suction channel 22. By example and without limitation, the generally fan shaped body 32 of the suction head 20 may be formed with the slightly inversely arched or "swaybacked" upper body portion 34 communicating at its upper crown 36 with a with the tubular conduit 38. The generally straight skirt portion 44 of the wide foot portion 40 is rotated away from the inversely arched upper body portion 34 by the curved neck portion 42. Instead of the elongated ovoids 60, 62 and connecting channel 64 shown in FIGS. 5 through 12, as illustrated here the skirt portion 44, which terminates in the lips 26, 28 of the intake opening 30, is formed with substantially planar front and back walls 92 and 94 that are also spaced apart a substantially constant width.

Figure 15:
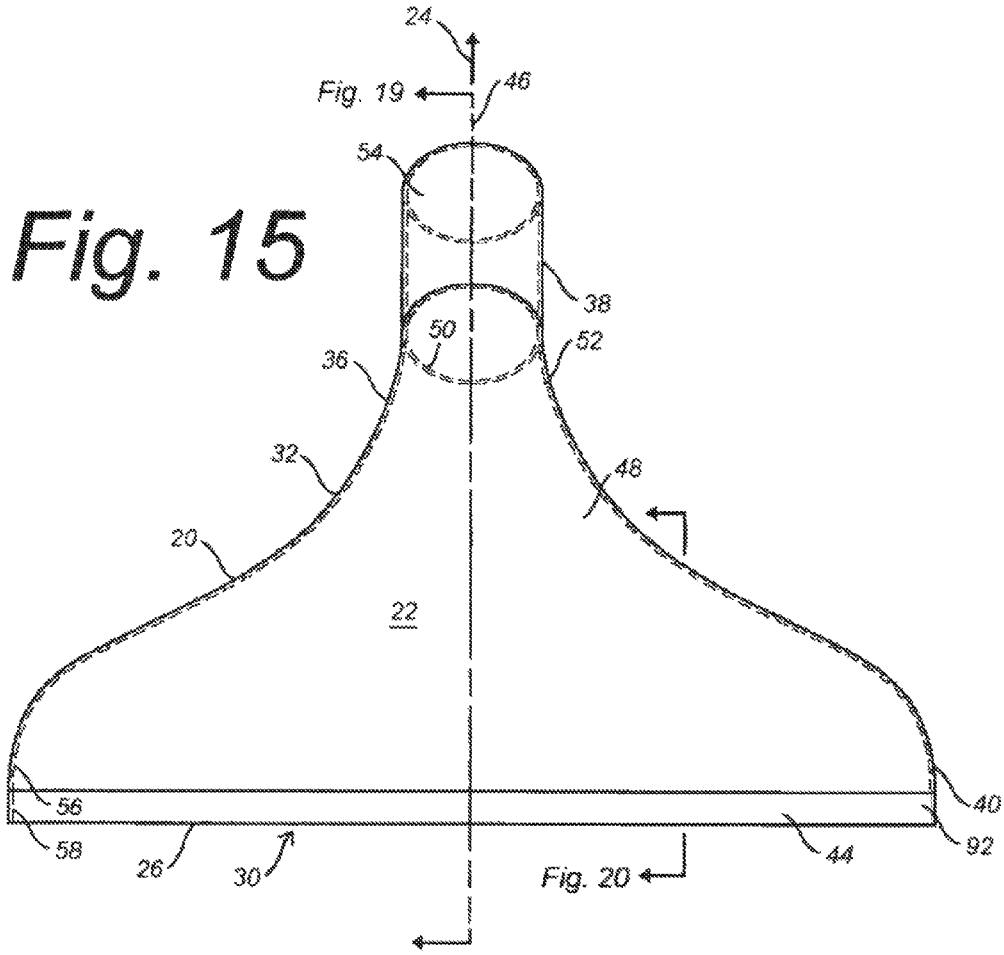

FIGS. 15 through 20 illustrate detail views of the alternative novel suction head 20 for a carpet cleaning wand as illustrated pictorially in FIG. 14. The front view of FIG. 15 shows the suction head 20 and alternative novel suction channel 22 (dashed lines) formed internally thereof. Here, both the generally fan shaped body 32 and internal suction channel 22 of the suction head 20 are more clearly shown as being substantially symmetric about their common centerline 46. As more clearly illustrated in subsequent figures, the alternative novel suction channel 22 having the shortened non-uniform cross section is contoured as a generally fan shaped channel having substantially smooth-walls throughout. The shortened non-uniform cross section of the novel generally fan shaped suction channel 22 is formed within the slightly arched upper suction channel portion 48 that is smoothly faired into fluid communication at its outlet 50 adjacent to the upper apex 52 with the smooth-walled and substantially cylindrical exhaust channel 54 of the tubular conduit 38 which is led to the suction-generator unit.

Figure 16:
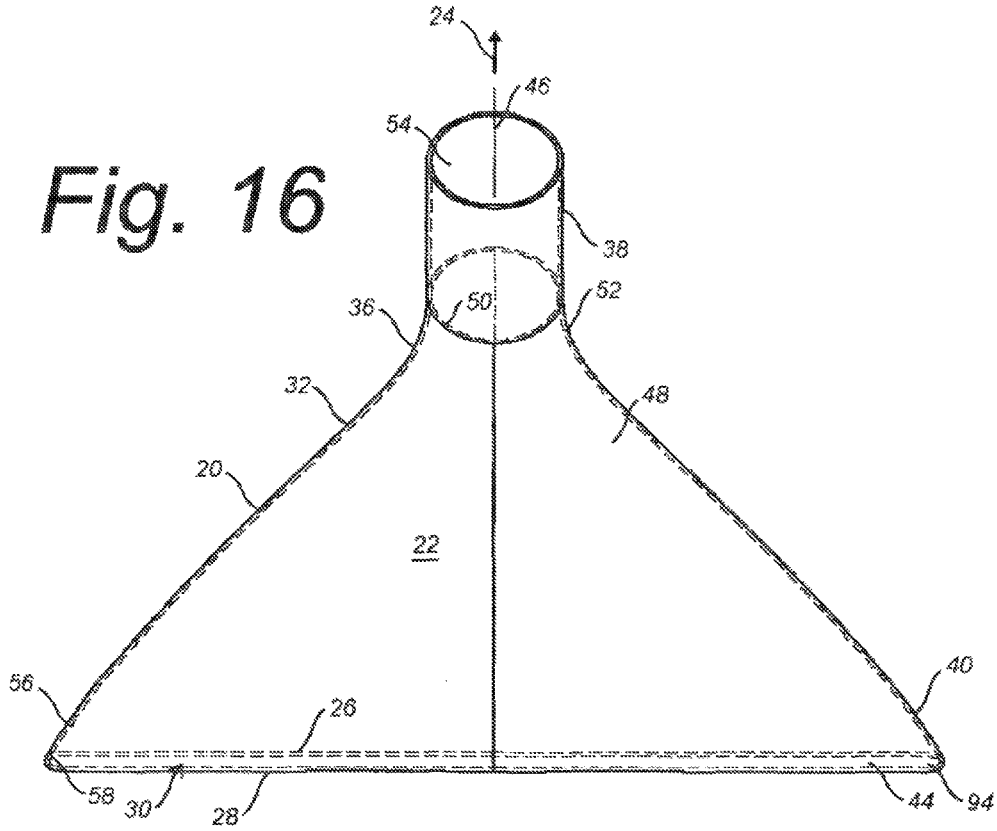

The top view of FIG. 16 also shows the body 32 and internal suction channel 22 (dashed lines) of the alternative suction head 20 being substantially symmetric about the common centerline 46. FIG. 16 also shows the body 32 of the alternative suction head 20 being generally fan shaped. As more clearly shown here, the intake opening 30 (dashed lines) is illustrated here as having the substantially constant spacing between the substantially planar front and back walls 92, 94 of the skirt portion 44 across the direction of air flow (arrow 24) because the shortened non-uniform cross section of the alternative suction channel 22 is restricted to a portion of its slightly arched upper suction channel portion 48.

Figure 17:
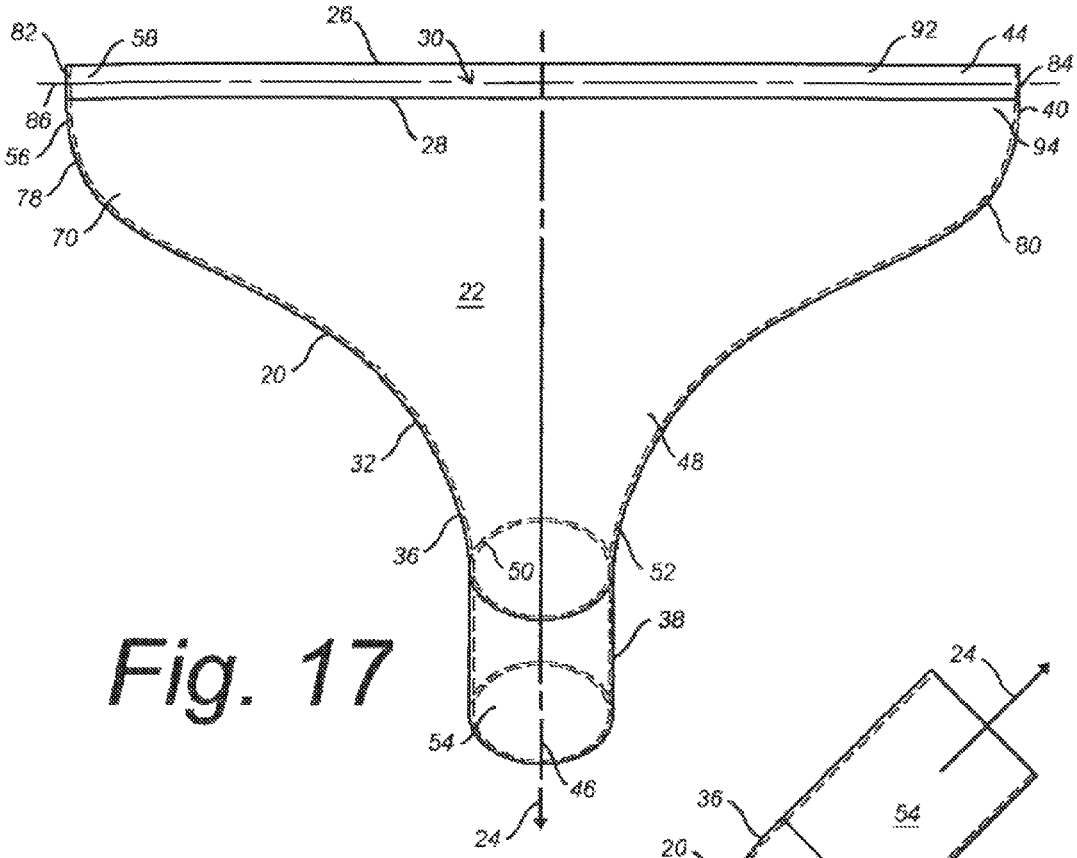

The bottom view of FIG. 17 also shows the symmetry about common centerline 46 of the body 32 of the suction head 20 with the alternative internal suction channel 22 (dashed lines) having the shortened non-uniform cross section. Furthermore, the intake opening 30 is illustrated here as having the substantially constant spacing between the substantially planar front and back walls 92, 94 of the skirt portion 44 across the direction of air flow (arrow 24) because the shortened non-uniform cross section of the alternative suction channel 22 is restricted to a portion of its slightly arched upper suction channel portion 48.

Also shown here is the upper suction channel portion 48 of the internal suction channel 22 being smoothly faired into the substantially cylindrical exhaust channel 54 of the tubular conduit 38. Furthermore, the general fan shape of the internal suction channel 22 having the shortened non-uniform cross section is shown to extend smooth-walled from its outlet 50 at the upper apex 52 through the slightly arched upper suction channel portion 48 and terminal skirt portion 58 of the base portion 56, which terminates in the intake opening 30 having the substantially constant spacing between the substantially planar front and back walls 92, 94 of the skirt portion 44.

Figure 18:
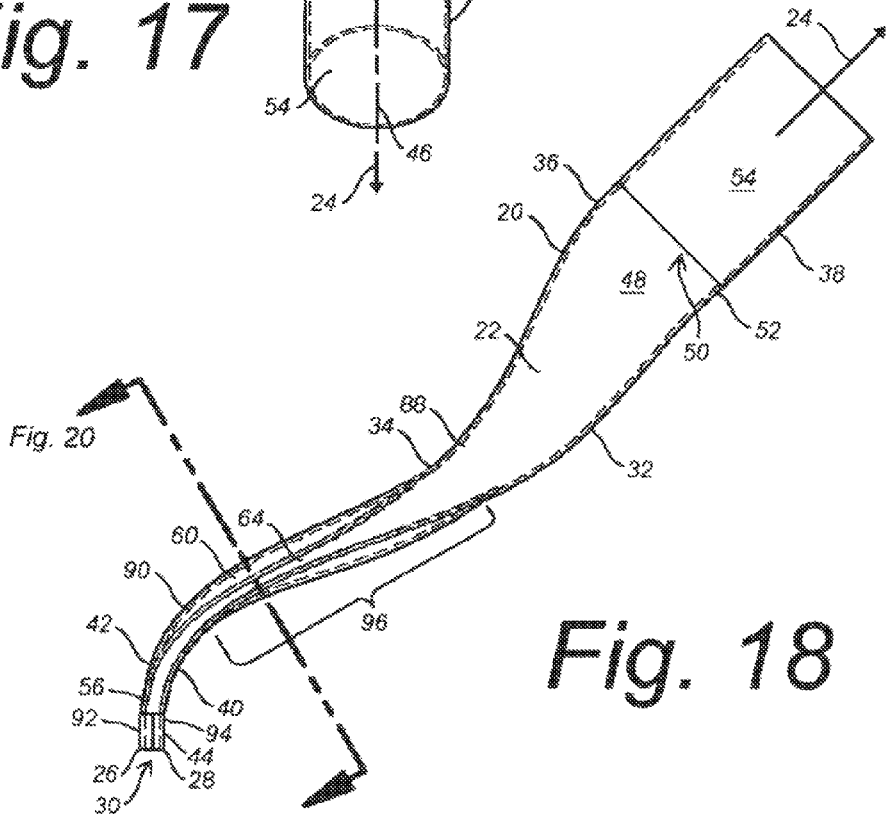

The side view of FIG. 18 shows the partially flattened cone or funnel shape of the body 32 of the suction head 20 with the alternative internal suction channel 22 (dashed lines) having the shortened non-uniform cross section. The body 32 of the suction head 20 is shown here having the slightly "sway-backed" upper body portion 34 formed with the inverse arch and communicating at its upper crown 36 with the tubular conduit 38. The neck portion 42 of the fan shaped body 32 is shown gently curving out of the inversely arched portion 34 and into the wide foot portion 40 for gently rotating the generally straight skirt portion 44 away from the slightly inversely arched upper portion 34. The terminal skirt portion 44 of the fan shaped body 32 is shown as terminating in the intake opening 30 between the substantially constantly spaced apart substantially planar front and back walls 92, 94 of the skirt portion 44.

The dashed lines show the alternative novel internal suction channel 22 within the suction head 20 being of variable or non-uniform cross section across the direction of air flow (arrow 24) having the narrow connecting channel 64 spanning the centerline 46 between the pair of elongated ovoids 60, 62. The alternative novel internal suction channel 22 is thus commensurate with the alternative terminal inlet opening 30 and contiguous with the substantially constantly spaced apart lips 26, 28 thereof. The dashed lines also show the shortened non-uniform cross section of the alternative suction channel 22 being restricted to a lower portion 96 of its slightly arched upper suction channel portion 48 where it transitions into the curved neck portion 42 leading to the generally straight skirt portion 44 of the wide foot portion 40.

Figure 19:
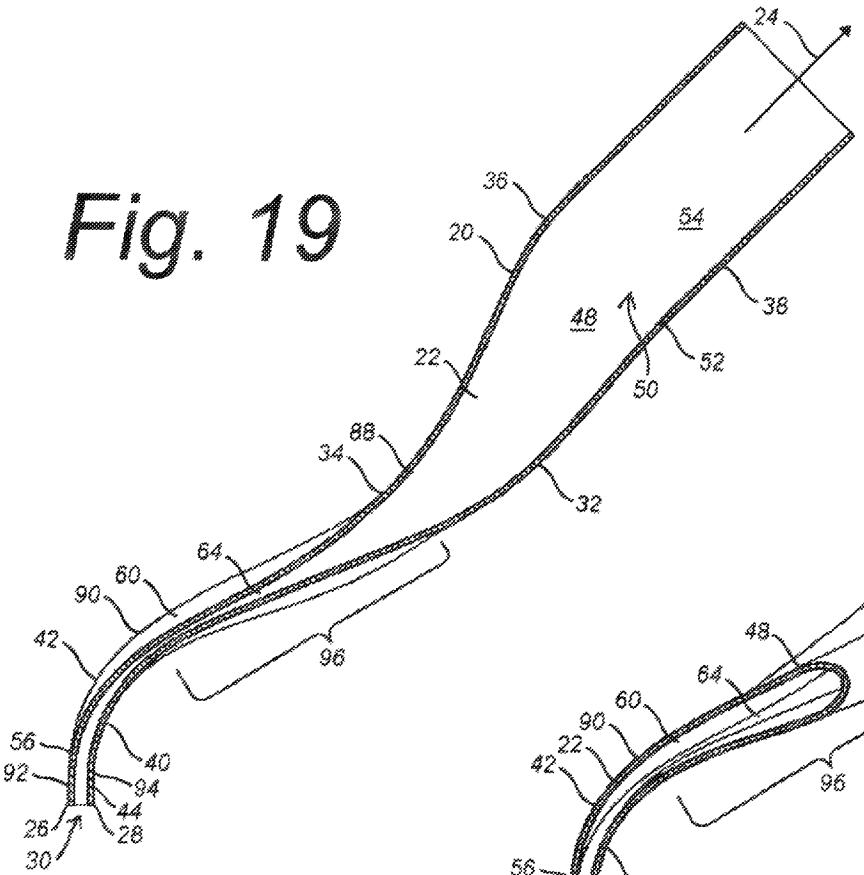

The cross section view of FIG. 19 is taken along the centerline 46 of the alternative suction head 20 showing the narrow connecting channel 64 spanning the centerline 46 and communicating between the pair of elongated ovoids 60, 62 of the alternative non-uniform internal suction channel 22 formed therein. The shortened non-uniform cross section of the alternative suction channel 22 is shown as restricted to a lower transition portion 96 of its slightly arched upper suction channel portion 48. The non-uniform cross section of the alternative suction channel 22 does not extend into the intake opening 30 in fluid communication therewith.

Figure 20:
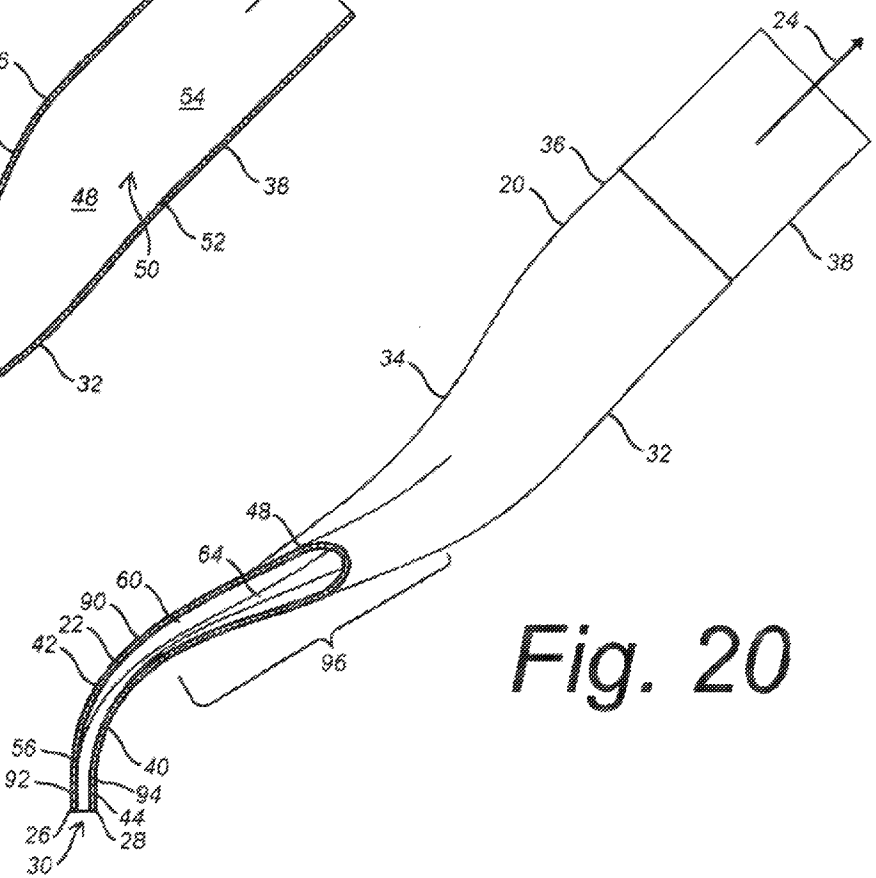

The cross section view of FIG. 20 is taken parallel to the centerline 46 of the suction head 20 through the nearer one of the pair of elongated oval portions 60, 62 of the alternative non-uniform internal suction channel 22. As illustrated, the general fan shape of the internal suction channel 22 causes the oval portions 60, 62 to taper into the generally tubular shape of its outlet 50 at the upper apex 52 and the crown 36 of the generally fan shaped body 32.

Figure 21:
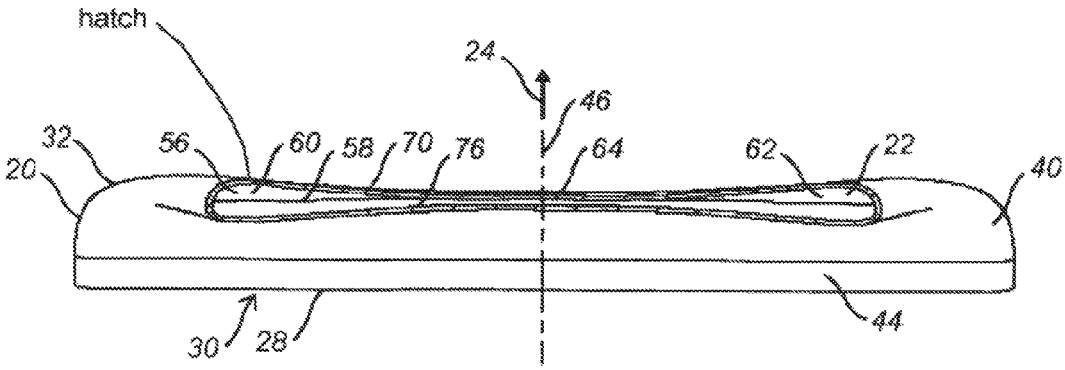
FIG. 21 is a cross section view showing contours of the non-uniform internal suction channel.

FIG. 21 is a cross section view through the suction head 20 and the alternative non-uniform internal suction channel 22 of FIG. 14 taken transversely of the centerline 46. Here, the novel double barrel appearance of the internal suction channel 22 is shown to be substantially symmetrical about the centerline 46. The cross sectional shape of the alternative non-uniform internal suction channel 22 shown here is thus substantially the same as the cross sectional shape shown in FIG. 9 for the non-uniform internal suction channel 22 having the elongated oval portions 60, 62 and interconnecting channel 64 extended through the lips 26 and 28 of the intake opening 30.

Figure 22:
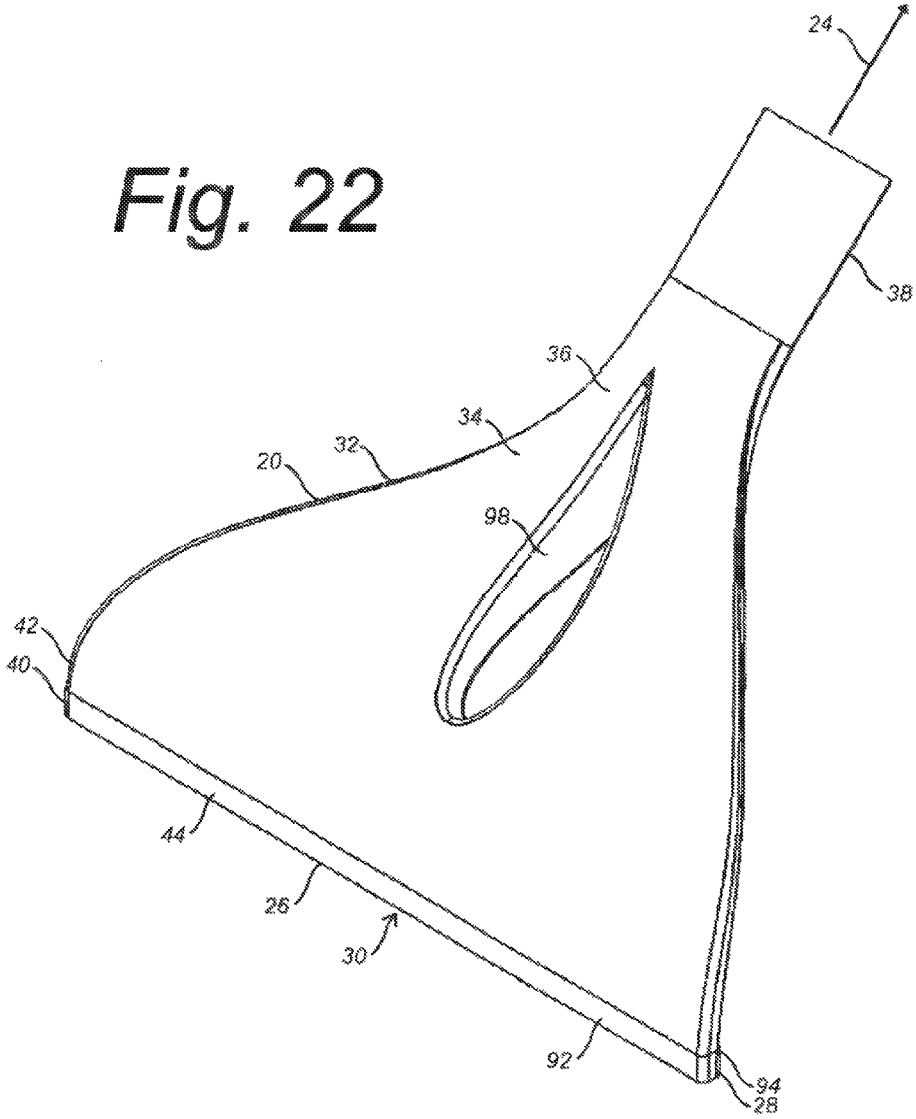
FIG. 22 is a pictorial view that illustrates another alternative novel suction head for a carpet cleaning wand, wherein another novel suction channel is formed with a substantially uniform cross section across the direction of air flow in combination with an airfoil oriented along the direction of air flow that produces dramatically more uniform flow distribution across lips of an intake opening thereinto.

FIG. 22 is a pictorial view that illustrates another alternative embodiment of the novel suction head 20 for a carpet cleaning wand, wherein the generally fan shaped body 32 is formed having the terminal lips 26, 28 being spaced apart by a substantially constant distance along the intake opening 30. Additionally, the novel internal suction channel 22 (illustrated in subsequent figures) formed within a substantially uniform cross section across the direction of air flow in combination with a novel smooth walled internal airfoil 98 oriented along the direction of air flow (indicated by arrow 24) and set back from the terminal inlet opening 30. The internal suction channel 22 is thus interrupted along its centerline 46 by the internal airfoil 98.

The novel internal airfoil 98 in combination with the substantially uniform cross section of the suction channel 22 also produces dramatically more uniform flow distribution across the substantially constantly spaced apart lips 26, 28 of an intake opening 30 that communicates with the suction channel 22. By example and without limitation, the generally fan shaped body 32 of the suction head 20 may be formed with the slightly inversely arched or "swaybacked" upper body portion 34 communicating at its upper crown 36 with a with the tubular conduit 38. The generally straight skirt portion 44 of the wide foot portion 40 is rotated away from the inversely arched upper body portion 34 by the curved neck portion 42. Instead of the elongated ovoids 60, 62 and connecting channel 64 shown in FIGS. 5 through 12, as illustrated here the skirt portion 44, which terminates in the lips 26, 28 of the intake opening 30, is formed with the substantially planar front and back walls 92, 94 that are also spaced apart a substantially constant width.

The novel internal airfoil 98 is illustrated here as an elongated teardrop shape that is oriented along the air flow direction 24 substantially transverse of the lips 26, 28 and intake opening 30. The elongated teardrop shape of the internal airfoil 98 is a substantially closed surface positioned within the novel internal suction channel 22. By example and without limitation, the elongated teardrop shape of the internal airfoil 98 is formed with a relatively wide, substantially smooth convexly curved leading surface portion 100 facing toward the intake opening 30 and tapers toward the outlet 50 at the upper apex 52 of the internal suction channel 22. As illustrated here by example and without limitation, the airfoil 98 is a walled cutout formed through the upper body portion 34 of the alternative novel suction head 20. However, the internal airfoil 98 is alternatively formed as a closed chamber or solid mass within the internal suction channel 22. Therefore, be it known that one or more other configurations of the internal airfoil 98 are also contemplated and may be substituted without deviating from the scope and intent of the present invention.

Figure 23:
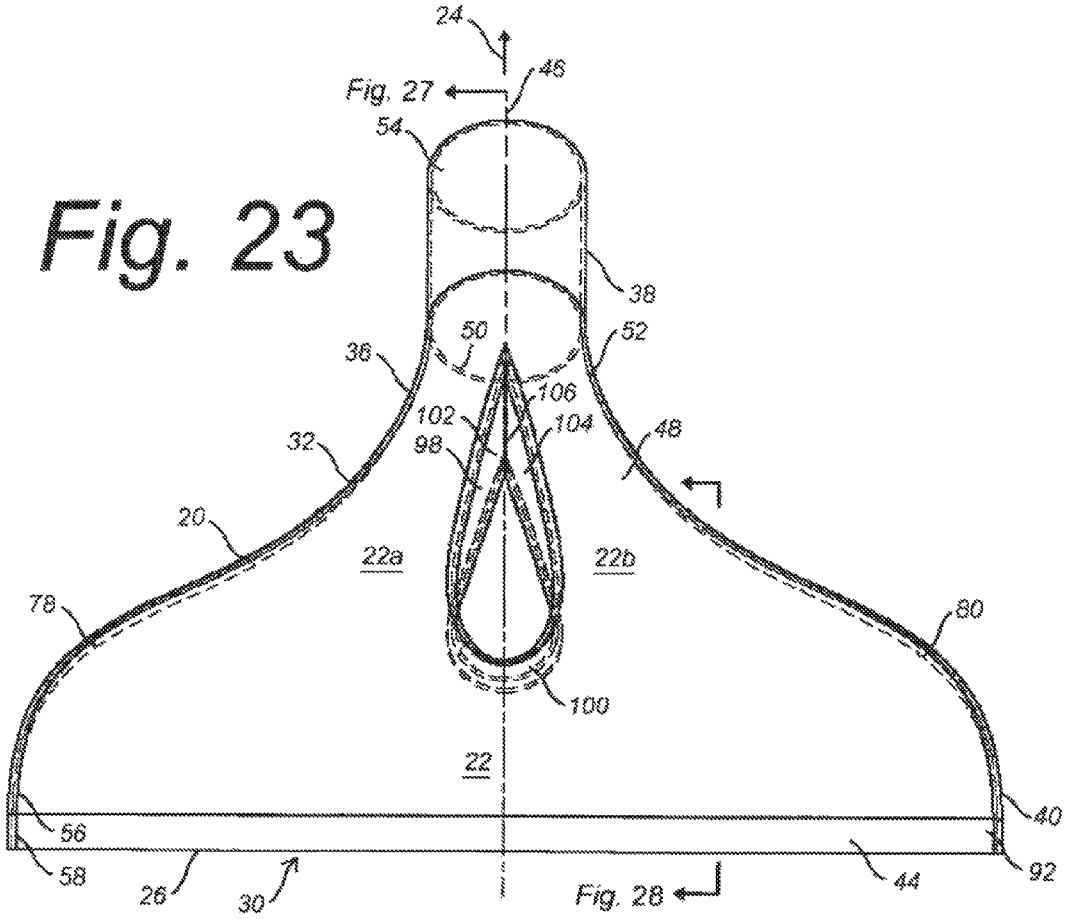

FIGS. 23 through 29 illustrate detail views of the alternative novel suction head 20 for a carpet cleaning wand as illustrated pictorially in FIG. 22. The front view of FIG. 23 shows the suction head 20 and alternative novel suction channel 22 (dashed lines) formed internally thereof. Here, both the generally fan shaped body 32 and internal suction channel 22 of the suction head 20 are more clearly shown as being substantially symmetric about their common centerline 46. As more clearly illustrated in subsequent figures, the alternative novel suction channel 22 is interrupted by the internal airfoil 98.

The substantially closed surface of the elongated teardrop-shaped internal airfoil 98 is formed with the substantially smooth convex curved or arcuate leading surface portion 100 facing toward the intake opening 30. Opposing substantially smooth side wall surface portions 102 and 104 extend from the arcuate leading surface portion 100 substantially symmetrically along the centerline 46 and lead toward the outlet 50 at the upper apex 52 of the generally fan shaped internal suction channel 22. The opposing side wall surfaces 102, 104 are optionally slightly arcuate or convexly curved outwardly toward the lateral wall surfaces 78, 80 of the internal suction channel 22. The elongated teardrop shape of the closed-surface internal airfoil 98 tapers away from the arcuate leading surface portion 100 such that the opposing side wall surface portions 102, 104 come together gently and meet smoothly in a sharp trailing edge joint 106 at the upper apex 52 of the internal suction channel 22 adjacent to its outlet 50. The convex leading surface 100 of the internal airfoil 98 smoothly divides the upper suction channel portion 48 of the suction channel 22 along its centerline 46 into left and right channel portions 22*a* and 22*b*. The left and right channel portions 22*a*, 22*b* are smoothly faired into fluid communication adjacent to the outlet 50 by the substantially smooth opposing side wall surfaces 102, 104. The left and right channel portions 22*a*, 22*b* are thus smoothly faired into the substantially cylindrical exhaust channel 54 of the tubular conduit 38 which is led to the suction-generator unit.

Figure 24:
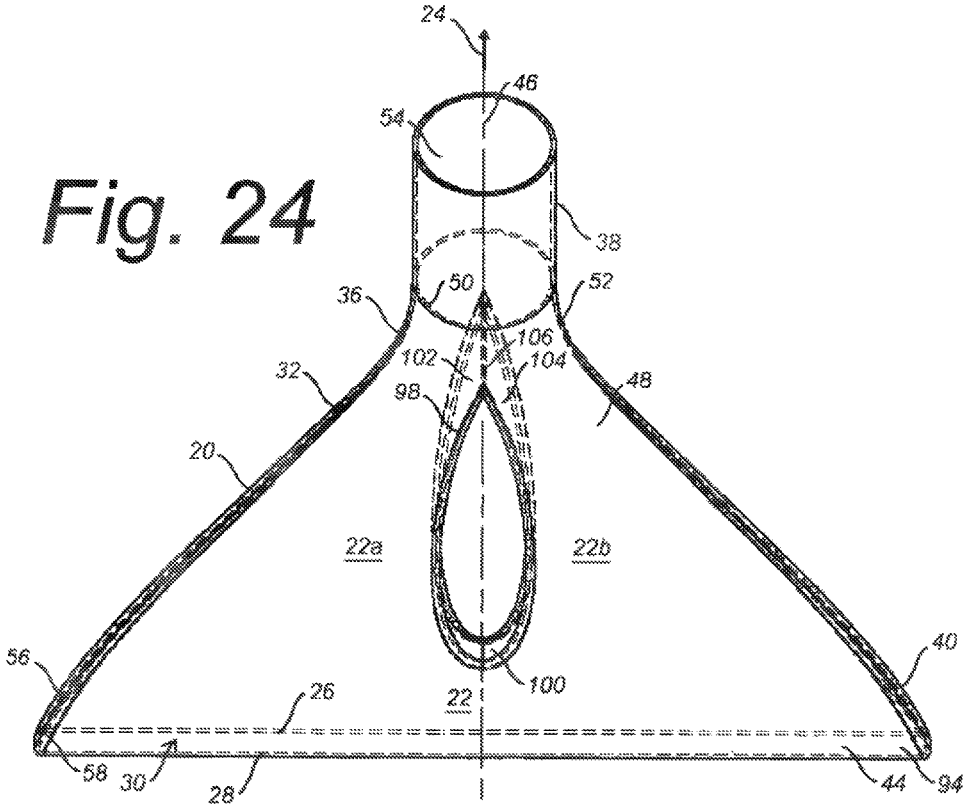

The top view of FIG. 24 also shows the body 32 of the alternative suction head 20 being generally fan shaped. FIG. 24 also shows the uniform cross section of the slightly arched upper suction channel portion 48 of the internal suction channel 22 (dashed lines) being interrupted by the internal airfoil 98 and divided about centerline 46 into the substantially symmetric left and right channel portions 22*a*, 22*b*. As more clearly shown here, the intake opening 30 (dashed lines) is also illustrated as having the substantially constant spacing between the substantially planar front and back walls 92, 94 of the skirt portion 44 across the direction of air flow (arrow 24).

Figure 25:
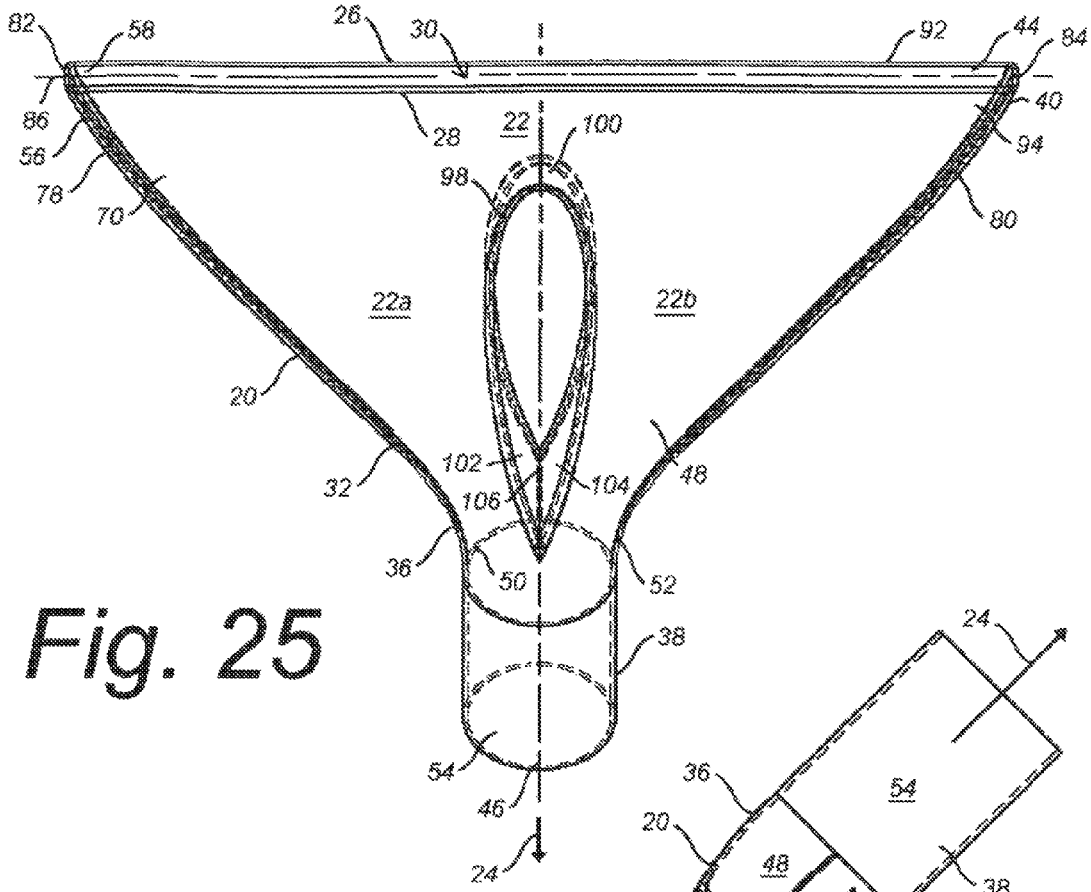

The bottom view of FIG. 25 also shows the symmetry about common centerline 46 of the body 32 of the suction head 20 with the substantially uniform cross section of the alternative internal suction channel 22 (dashed lines). The internal suction channel 22 is illustrated here as being interrupted by the internal airfoil 98 and divided about centerline 46 into the substantially symmetric left and right channel portions 22*a* and 22*b*.

The general fan shape of the internal suction channel 22 having the uniform cross section is shown to extend smooth-walled from its outlet 50 at the upper apex 52 through the slightly arched upper suction channel portion 48 and terminal skirt portion 58 of the base portion 56, which terminates in the intake opening 30 having the substantially constant spacing between the substantially planar front and back walls 92, 94 of the skirt portion 44. Also shown here is the intake opening 30 having the substantially constant spacing between the substantially planar front and back walls 92, 94 of the skirt portion 44 across the direction of air flow (arrow 24).

Furthermore, the substantially symmetric left and right channel portions 22*a* and 22*b* of the upper suction channel portion 48 are shown as being smoothly faired into the substantially cylindrical exhaust channel 54 of the tubular conduit 38 at the joint 106.

Figure 26:
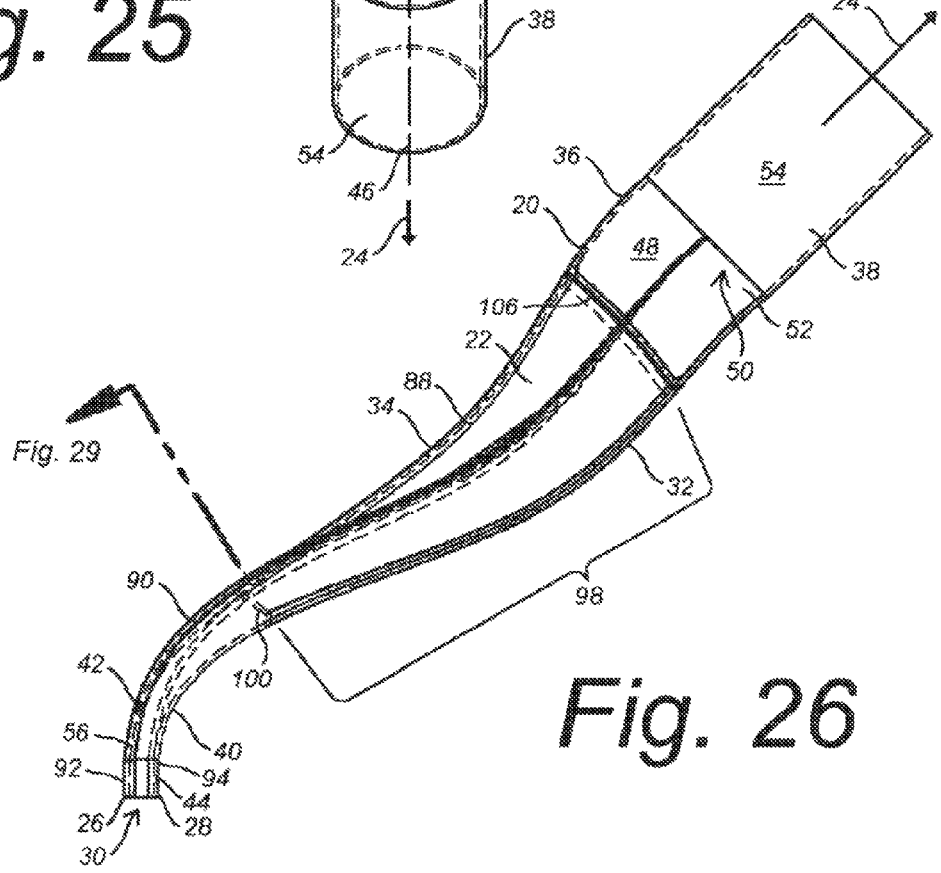

The side view of FIG. 26 shows the partially flattened cone or funnel shape of the body 32 of the suction head 20 with the alternative internal suction channel 22 (dashed lines) having the substantially uniform cross section. The body 32 of the suction head 20 is shown here having the slightly "sway-backed" upper body portion 34 formed with the inverse arch and communicating at its upper crown 36 with the tubular conduit 38. The neck portion 42 of the fan shaped body 32 is shown gently curving out of the inversely arched portion 34 and into the wide foot portion 40 for gently rotating the generally straight skirt portion 44 away from the slightly inversely arched upper portion 34. The terminal skirt portion 44 of the fan shaped body 32 is shown as terminating in the intake opening 30 between the substantially constantly spaced apart substantially planar front and back walls 92, 94 of the skirt portion 44.

The dashed lines show the alternative novel internal suction channel 22 within the suction head 20 being of substantially uniform cross section across the direction of air flow (arrow 24) which eliminates the pair of elongated ovoids 60, 62 and the narrow connecting channel 64. The alternative novel internal suction channel 22 is thus commensurate with the alternative terminal inlet opening 30 and contiguous with the substantially constantly spaced apart lips 26, 28 thereof. The dashed lines also show the internal airfoil 98 interrupting the suction channel 22 within its slightly arched upper suction channel portion 48. The wider convex leading surface portion 100 of the internal airfoil 98 is shown as set back from the terminal inlet opening 30 to interrupt the upper suction channel portion 48 where it transitions into the curved neck portion 42 leading to the generally straight skirt portion 44 of the wide foot portion 40. The internal airfoil 98 terminates where its tapering side wall surfaces 102, 104 come together and meet in the smooth joint 106 at the upper apex 52 of the internal suction channel 22 adjacent to its outlet 50.

Figure 27:
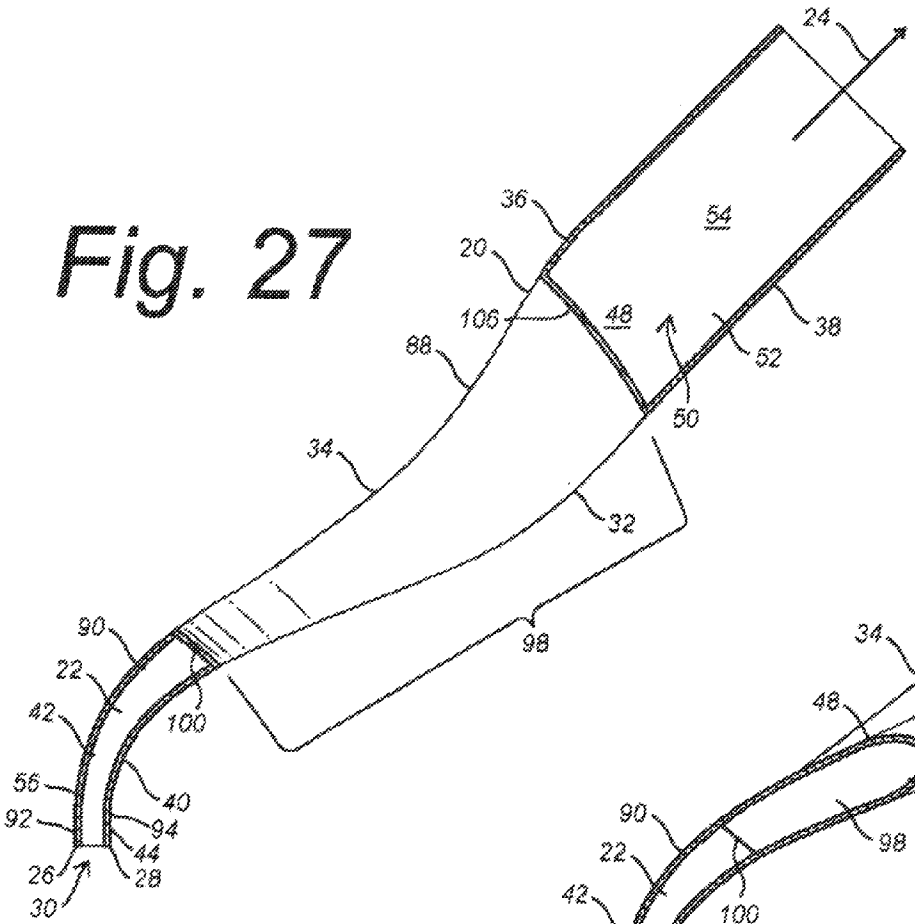

The cross section view of FIG. 27 is taken along the centerline 46 of the alternative suction head 20 showing the internal airfoil 98 spanning the centerline 46 and interrupting the alternative substantially uniform internal suction channel 22 formed therein. The internal airfoil 98 is shown as restricted at its leading surface 100 and trailing edge joint 106 to the slightly arched upper suction channel portion 48. The substantially uniform cross section of the alternative suction channel 22 thus extends into the intake opening 30 in fluid communication therewith.

Figure 28:
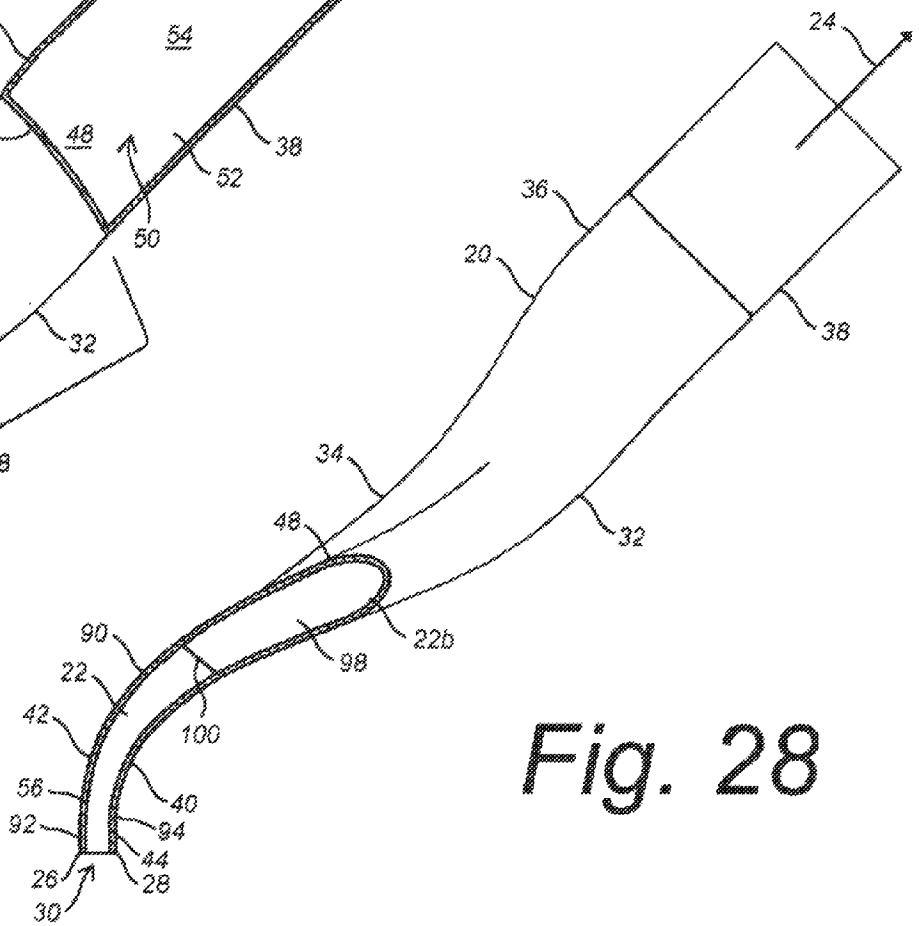

The cross section view of FIG. 28 is taken parallel to the centerline 46 of the suction head 20 through the length of substantially uniform internal suction channel 22. As illustrated, the internal airfoil 98 is restricted to the area around the centerline 46 so that the general fan shape of the internal suction channel 22 is not interrupted within the left and right channel portions 22*a*, 22*b* of the slightly arched upper suction channel portion 48 as they extend into the intake opening 30.

Figure 29:
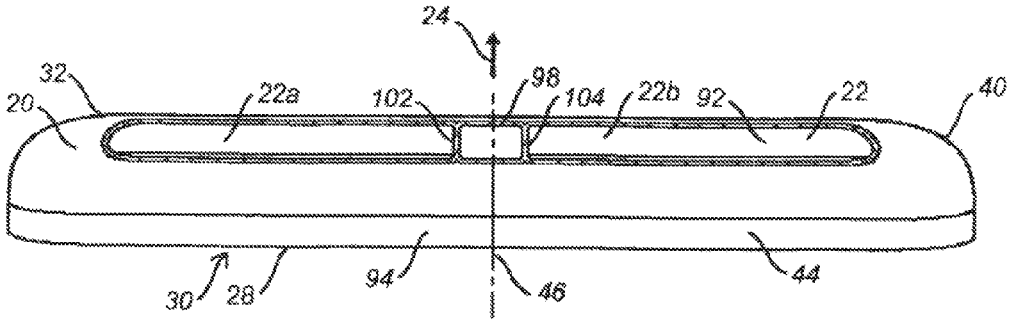

FIG. 29 is a cross section view through the suction head 20 of FIG. 22 taken transversely of the centerline 46. The internal airfoil 98 is shown interrupting the alternative substantially uniform internal suction channel 22 and dividing the upper suction channel portion 48 into the substantially symmetric left and right channel portions 22*a*, 22*b*. Here, the internal airfoil 98 and left and right channel portions 22*a*, 22*b* are shown to be substantially symmetrical about the centerline 46. The alternative internal suction channel 22 shown here is thus substantially uniform in cross sectional shape across the direction of air flow (arrow 24) between the substantially planar front and back walls 92, 94 of the skirt portion 44. The substantially uniform cross sectional shape of the alternative internal suction channel 22 is extended between the substantially planar front and back walls 92, 94 through the lips 26 and 28 of intake opening 30.

Figure 30:
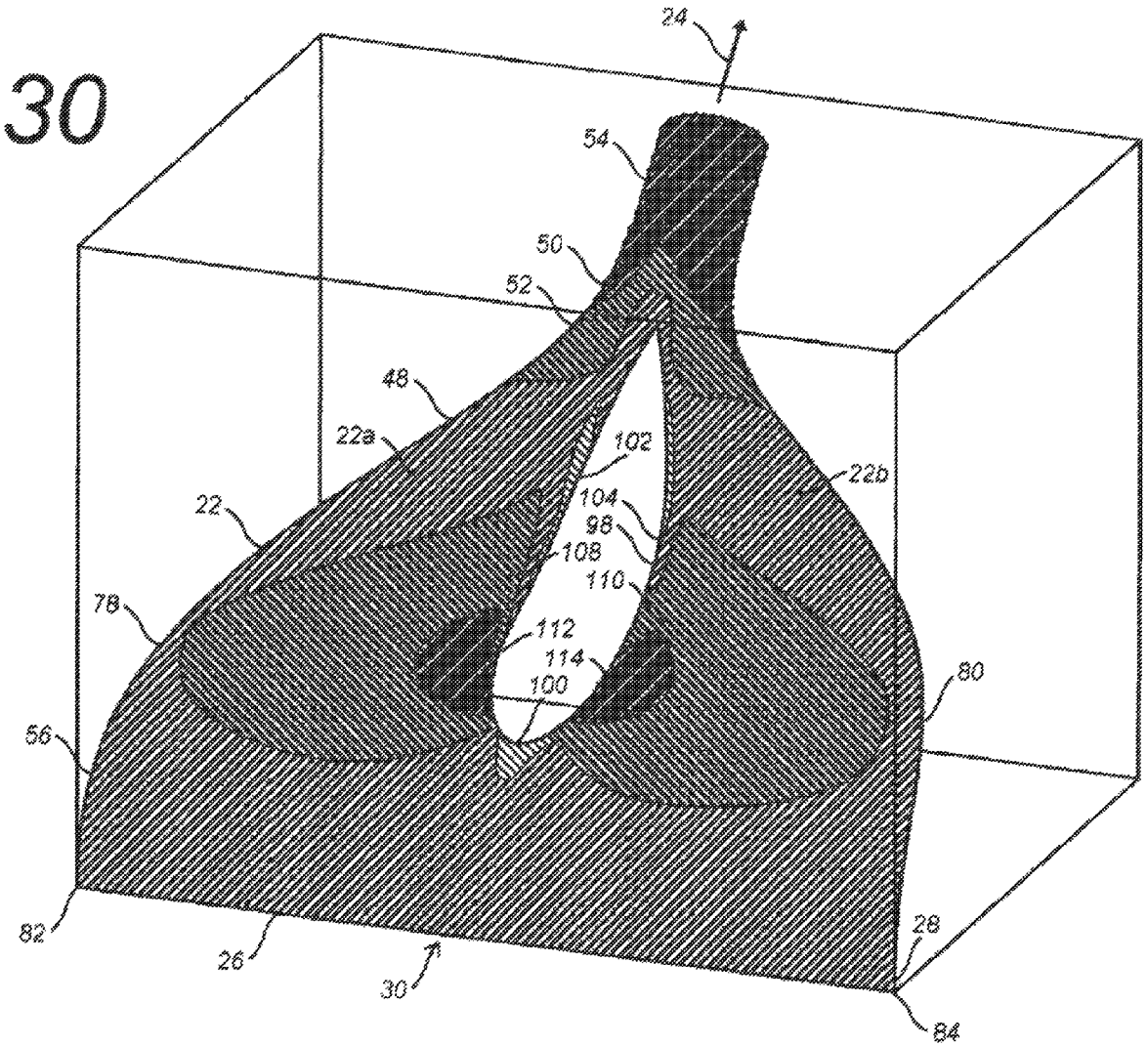
FIG. 30 is a heuristic chart illustrating flow velocity through the substantially uniform cross section of the suction channel of the alternative novel carpet cleaning wand illustrated in FIGS. 22 through 29 as interrupted by the airfoil.

FIG. 30 illustrates the substantially uniform flow velocity through the substantially uniform cross section of the suction channel 22 of the novel carpet cleaning suction head 20 interrupted by the internal airfoil 98, as illustrated in FIGS. 22 through 29. As illustrated here, the substantially uniform flow velocity across the width of the intake opening lips 26, 28 of the intake opening 30 that is applied to the surface to be cleaned is determined by the novel shape of the substantially uniform internal suction channel 22 extended through the body 32 and interrupted by the internal airfoil 98.

As illustrated here, the flow velocity is a maximum in the exhaust channel 54 of the tubular conduit 38 leading to the suction-generator unit, and slowing slightly in the upper apex 52 of the internal suction channel 22 adjacent to the smooth-walled outlet 50. The flow velocity is reduced in the arched upper suction channel portion 48 of the suction channel 22 as it fans out from the apex 52 and is smoothly divided into the left and right channel portions 22*a*, 22*b* along the centerline 46 by the smooth side wall surfaces 102, 104 of the internal airfoil 98. However, while initially slowing slightly in the upper channel portions 22*a*, 22*b* of the suction channel portion 48, the flow velocity increases in substantially symmetric zones 108 and 110 away from the upper apex 52 toward the curving throat portion 90 leading out of the inversely curved arch 88 of the upper suction channel portion 48 and into the base portion 56 of the fan shaped suction channel 22. Yet, the flow velocity remains substantially uniform across the width of the suction channel 22 as it continues to fan out toward the opposing extreme lateral wall surfaces 78, 80 of the suction channel 22, except for substantially symmetric extremely high flow rate zones 112 and 114 against the opposing side wall surfaces 102, 104 where the air flow races around of the internal airfoil 98 adjacent to its leading surface 100.

The flow velocity in the suction channel 22 decreases slightly in a small stall zone adjacent to the barrier of the airfoil's leading surface 100. In this way, the internal airfoil 98 operates similarly to the top of a wing forcing the nearer air flow to speed up through the longer path around the arcuate side wall surfaces 102, 104 to remain with the air flow in the relatively uninterrupted zones 108, 110. The flow velocity actually remains substantially unchanged adjacent to the extreme lateral wall surfaces 78, 80 of the suction channel 22 farthest from the interrupting airfoil 98.

However, away from the airfoil's leading surface 100 the substantially stalled air flow adjacent the airfoil's leading surface 100 subsides into the air flow in the less interrupted zones 108, 110, as does the air flow in the extremely high flow rate zones 112, 114. The flow velocity evens out and becomes substantially uniform across the suction channel 22 approaching the smooth-walled base portion 56 toward the intake opening 30. The interruption of the internal suction channel 22 by the internal airfoil 98 thus force the flow velocity to be extremely uniform across the entire width of the suction channel 22 between the opposing extreme lateral wall surfaces 78, 80 as it fans out toward the opposing lips 26, 28 of the intake opening 30. The flow velocity remains substantially uniform across substantially the entire width of the intake opening 30 between the extreme lateral portions 82, 84 of the lips 26, 28. Additionally, the substantially uniform flow velocity across substantially the entire width of the intake opening 30 is in the same range as the maximum flow velocity attained near the centerline 12 of the intake opening 5 for the internal suction channel 2 of the prior art suction head 1, as illustrated in FIG. 4, but does not falling off away from the centerline 46 as occurs in the prior art suction head 1 around its centerline 12.

Figure 31:
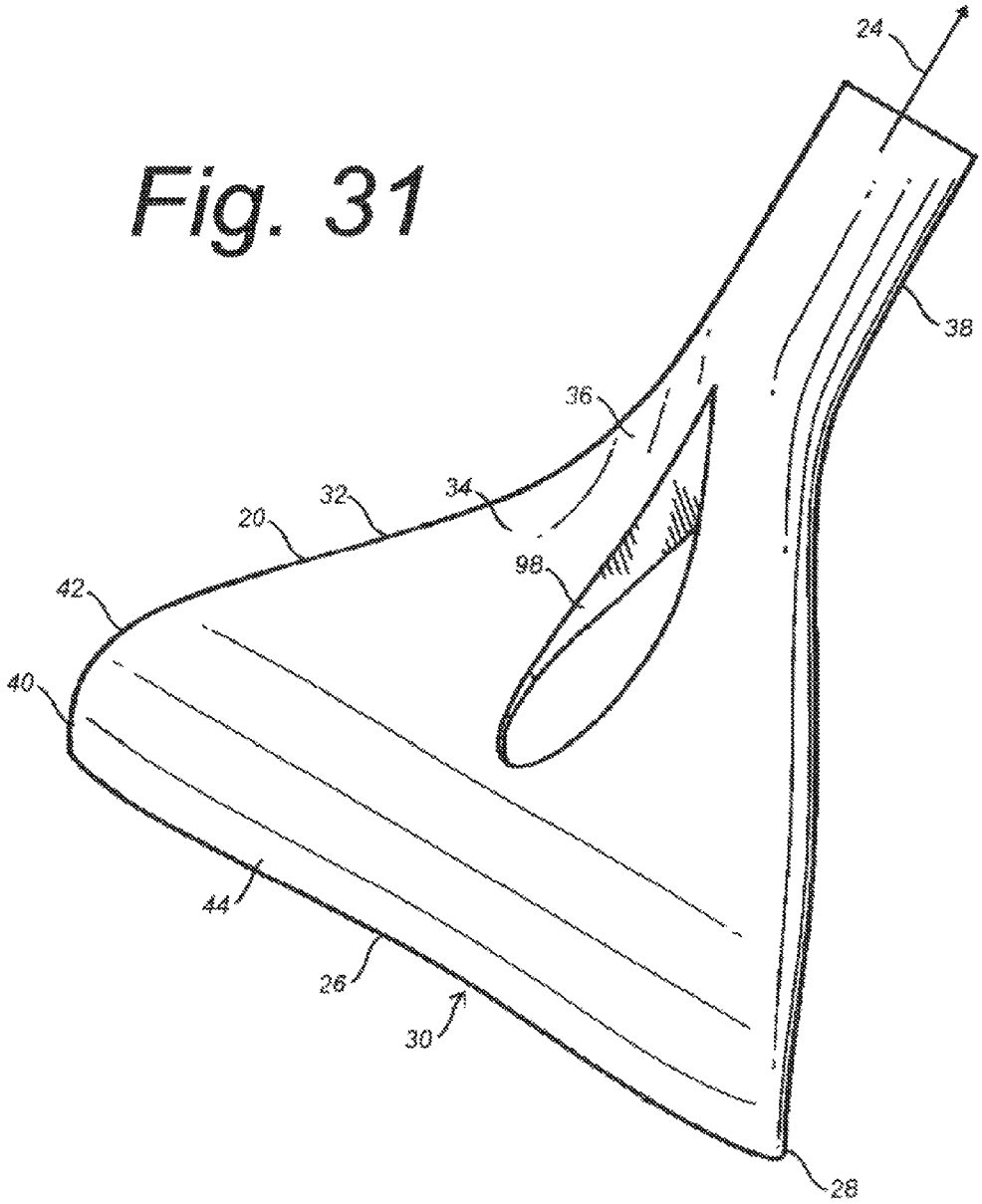
FIG. 31 is a pictorial view that illustrates another alternative novel suction head for a carpet cleaning wand, wherein an alternative suction channel is formed with the non-uniform cross section across the direction of air flow in combination with the airfoil oriented along the direction of air flow that together produce dramatically more uniform flow distribution across lips of an intake opening thereinto.

FIG. 31 is a pictorial view that illustrates another alternative embodiment of the novel suction head 20 for a carpet cleaning wand, wherein an alternative novel internal suction channel 22 (illustrated in subsequent figures) is formed with the non-uniform cross section across the direction of air flow (indicated by arrow 24) in combination with the novel smooth walled internal airfoil 98 oriented along the direction of air flow (indicated by arrow 24) that together produce dramatically more uniform flow distribution across the lips 26, 28 of intake opening 30 that communicates with the suction channel 22.

Figure 32:
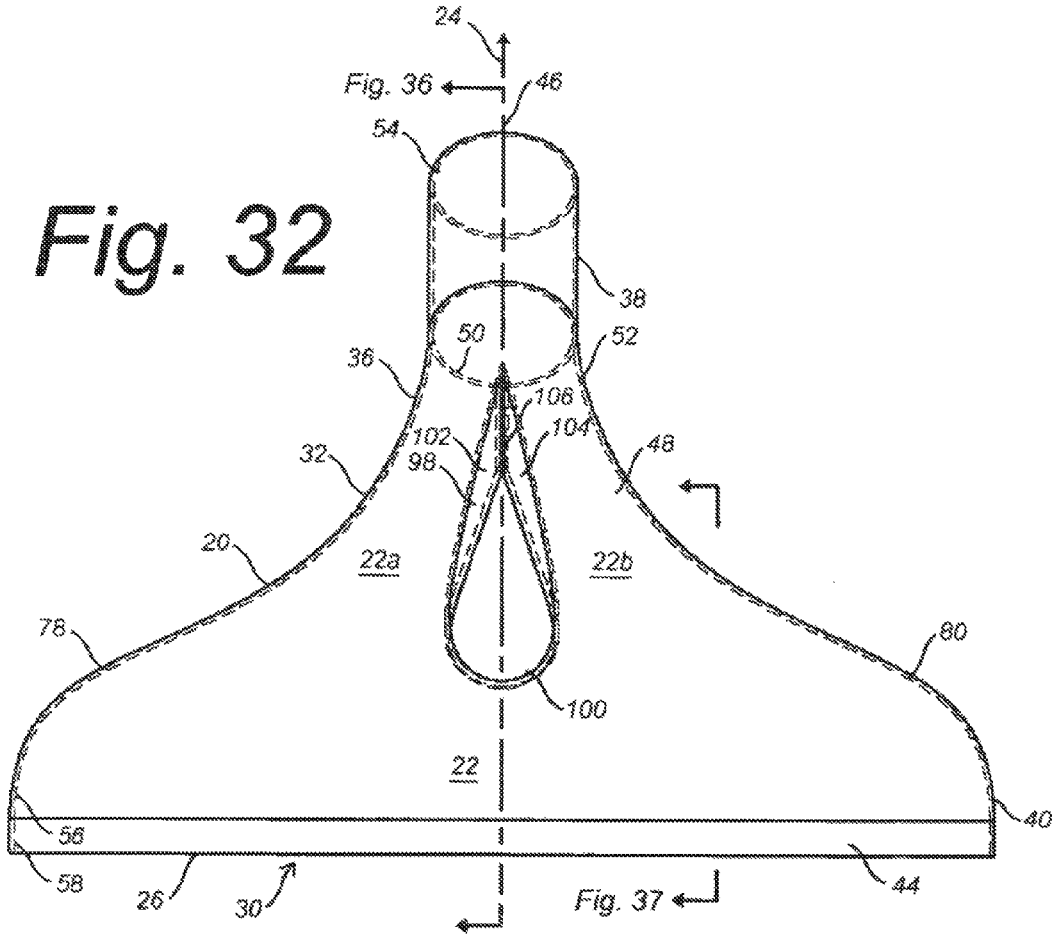

FIGS. 32 through 38 illustrate detail views of the alternative novel suction head 20 for a carpet cleaning wand as illustrated pictorially in FIG. 31. The front view of FIG. 32 shows the alternative suction head 20 and alternative novel suction channel 22 (dashed lines) formed internally thereof. Here, both the generally fan shaped body 32 and internal suction channel 22 of the suction head 20 are more clearly shown as being substantially symmetric about their common centerline 46. As more clearly illustrated in subsequent figures, the alternative novel suction channel 22 is contoured as a generally fan shaped channel having substantially smooth-walls throughout. The shortened non-uniform cross section of the novel generally fan shaped suction channel 22 is formed within the slightly arched upper suction channel portion 48 that is smoothly faired into fluid communication at its outlet 50 adjacent to the upper apex 52 with the smooth-walled and substantially cylindrical exhaust channel 54 of the tubular conduit 38 which is led to the suction-generator unit.

Opposite from its outlet 50 at the apex 52 thereof, the substantially smooth-walled upper suction channel portion 48 is smoothly faired into fluid communication with the wide and substantially smooth-walled base portion 56 of the fan shaped internal suction channel 22. The base portion 56 of the fan shaped suction channel 22 is formed with the generally straight terminal skirt portion 58 in fluid communication with the slightly arched upper suction channel portion 48. The terminal skirt portion 58 of the internal suction channel 22 is in fluid communication with the intake opening 30 between the terminal lips 26, 28, which places the slightly arched upper portion 48 in fluid communication therewith.

Furthermore, the alternative novel suction channel 22 is interrupted by the internal airfoil 98 having the elongated teardrop shape as discussed herein. The internal airfoil 98 is formed with the substantially smooth convex curved or arcuate leading surface 100 facing toward the intake opening 30 and the opposing substantially smooth side wall surfaces 102, 104 substantially symmetrically formed along the centerline 46 and leading toward the outlet 50 at the upper apex 52 of the generally fan shaped internal suction channel 22. The opposing side wall surfaces 102, 104 are illustrated here as being optionally slightly convex curved or arcuately formed facing outwardly toward the lateral wall surfaces 78, 80 of the internal suction channel 22. The opposing side wall surfaces 102, 104 come together and meet smoothly in the sharp trailing edge joint 106 at the upper apex 52 of the internal suction channel 22 adjacent to its outlet 50. The convex leading surface 100 of the internal airfoil 98 thus smoothly divides the upper suction channel portion 48 of the suction channel 22 along its centerline 46 into the substantially symmetric left and right channel portions 22*a* and 22*b*. The left and right channel portions 22*a*, 22*b* are smoothly faired into fluid communication adjacent to the outlet 50 by the substantially smooth opposing side wall surfaces 102, 104. The left and right channel portions 22*a*, 22*b* are thus smoothly faired into the substantially cylindrical exhaust channel 54 of the tubular conduit 38 which is led to the suction-generator unit.

Figure 33:
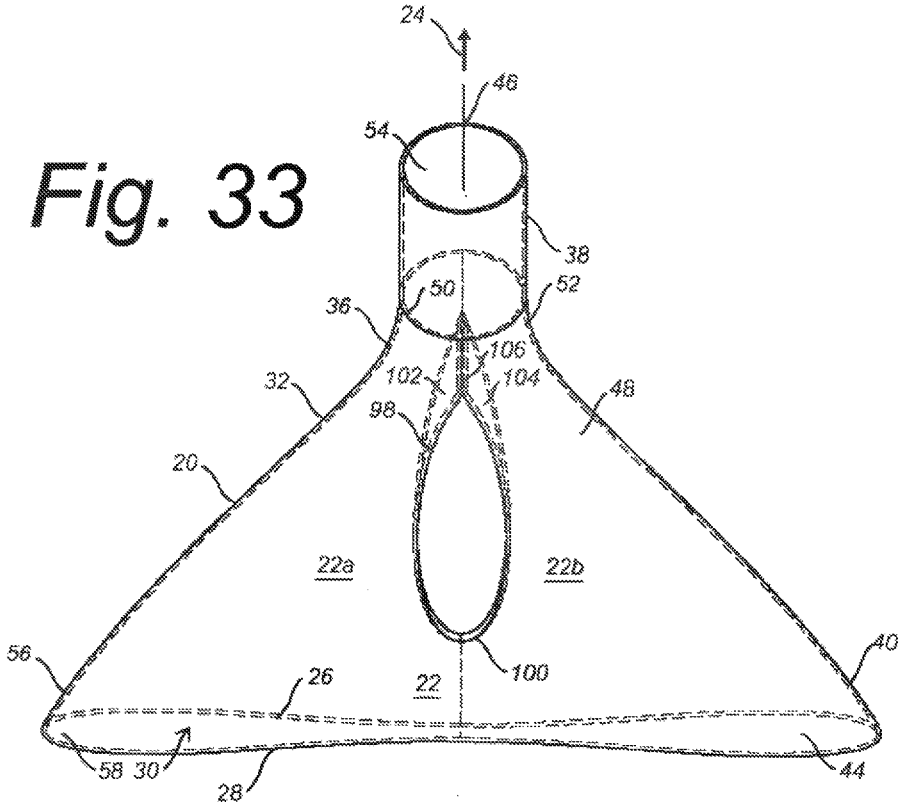

The top view of FIG. 33 also shows the body 32 and alternative internal suction channel 22 (dashed lines) of the alternative suction head 20 being substantially symmetric about their common centerline 46. FIG. 33 also shows the body 32 of suction head 20 being generally fan shaped. As more clearly shown here, the general fan shape of the body 32 extends from the crown 36 through the arched upper body portion 34 and curved neck portion 42 into the wide foot portion 40 and skirt portion 44, and terminates in the intake opening 30 (dashed lines). The intake opening 30 is illustrated here as having the non-uniform shape across the direction of air flow (arrow 24) being carried through from the non-uniform cross section of the suction channel 22.

As also shown here, the non-uniform cross section of the upper suction channel portion 48 of the internal suction channel 22 is smoothly faired into the substantially cylindrical exhaust channel 54 of the tubular conduit 38. Furthermore, the non-uniform cross section and the general fan shape of the internal suction channel 22 is shown to extend smooth-walled from its outlet 50 at the upper apex 52 through the slightly arched upper suction channel portion 48 and terminal skirt portion 58 of the base portion 56, which terminates in the non-uniform cross section of intake opening 30.

Furthermore, as illustrated here the non-uniform cross section of the slightly arched upper suction channel portion 48 of the alternative internal suction channel 22 (dashed lines) is interrupted by the internal airfoil 98 and divided about centerline 46 into the substantially symmetric left and right channel portions 22*a*, 22*b*. As more clearly shown here, the intake opening 30 (dashed lines) is also illustrated as having the non-uniform cross section between the lips 26, 28 oriented substantially transverse across the direction of air flow (arrow 24).

Figure 34:
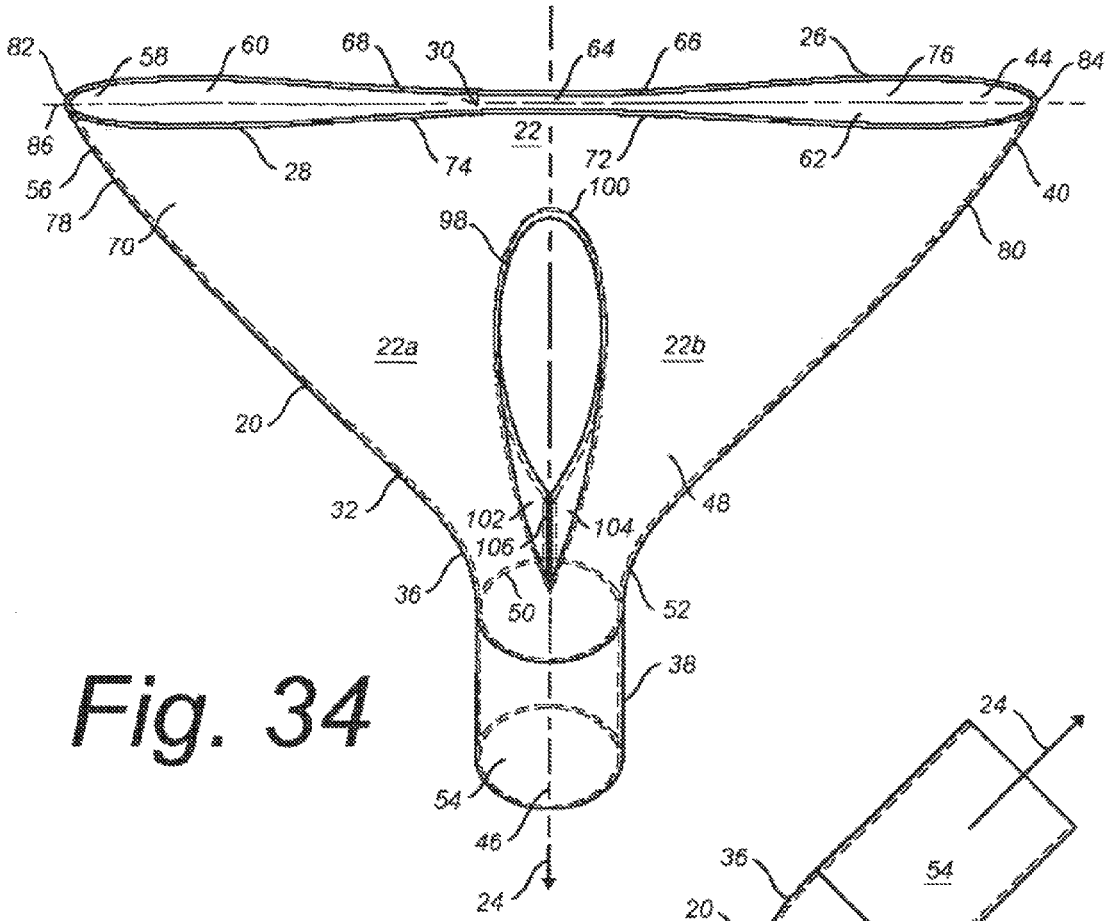

The bottom view of FIG. 34 also shows the symmetry about common centerline 46 of the body 32 and alternative internal suction channel 22 (dashed lines) of the alternative suction head 20. Furthermore, the intake opening 30 is illustrated here as having the non-uniform cross sectional shape across the direction of air flow (arrow 24) being carried through from the non-uniform cross section of the alternative suction channel 22. The non-uniform shape of the intake opening 30 and the internal suction channel 22 are more clearly shown here as being formed of the substantially continuous curve that is shaped substantially as a "dog bone" or an elongated figure "8" having the pair of substantially symmetric oval portions 60, 62 each elongated toward the centerline 46 and becoming relatively wider outwardly thereof, as discussed herein. As discussed herein, the elongated ovoids 60, 62 communicate through the relatively narrow transverse connecting channel 64 spanning the centerline 46. The elongated ovoids 60, 62 and narrow connecting channel 64 are continuously conjoined through the first pair of gently outwardly curving surfaces 66, 68 on the first or front wall surface 70 of the internal suction channel 22, and the second pair of gently oppositely outwardly curving surfaces 72, 74 on the second or back surface 76 thereof that substantially mirror the first pair of gently outwardly curving surfaces 66, 68. The non-uniform intake opening 30 and internal suction channel 22 thus gently increase in area outwardly of the centerline 46 toward opposing extreme lateral wall surfaces 78, 80 commensurate with lateral portions 82, 84 of the lips 26, 28 of the terminal inlet opening 30 and contiguous therewith. The elongated ovoids 60, 62 and narrow connecting channel 64 of the non-uniform cross section are shown here for the internal suction channel 22 and the intake opening 30 thereinto. Furthermore, the non-uniform cross section of the internal suction channel 22 is extended through the generally fan shaped body 32 from the intake opening 30 toward its outlet 50 into the substantially cylindrical exhaust channel 54 through the tubular conduit 38. The body 32 and internal suction channel 22 thus each have the novel double barrel appearance discussed herein that is formed substantially symmetrically about an axis 86 transverse of the centerline 46 as may be achieved, for example, by partially flattening a cone or funnel. As discussed herein, the resultant continuous non-uniform cross section of the suction channel 22 and intake opening 30 reduces resistance to fluid flow towards the lateral wall surfaces 78, 80 of the internal suction channel 22, which produces dramatically more uniform flow distribution across the lips 26, 28 of intake opening 30 than was possible in the prior art.

Furthermore, as illustrated here the substantially continuous non-uniform cross section internal suction channel 22 (dashed lines) is combined with the internal airfoil 98 discussed herein. Thus, by example and without limitation, the substantially continuous non-uniform cross section of the alternative internal suction channel 22 is shown as interrupted by the internal airfoil 98 and divided about centerline 46 into the substantially symmetric left and right channel portions 22*a* and 22*b*, as discussed herein.

Figure 35:
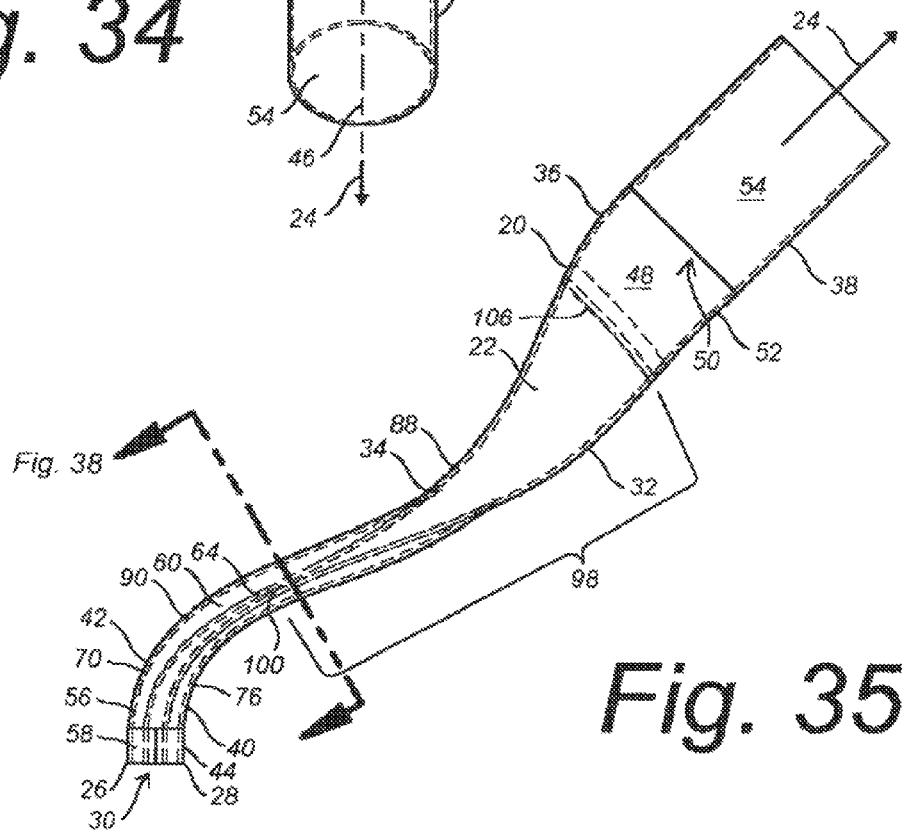

The side view of FIG. 35 shows the partially flattened cone or funnel shape of the body 32 and internal suction channel 22 (dashed lines) of the alternative suction head 20. The alternative suction head 20 is shown here having the generally fan shaped body 32 formed with the slightly "swaybacked" upper body portion 34 having the inverse arch and communicating at its upper crown 36 with the tubular conduit 38. The neck portion 42 of the fan shaped body 32 is shown gently curving out of the inversely arched portion 34 and into the wide foot portion 40 for gently rotating the generally straight skirt portion 44 away from the slightly inversely arched upper portion 34. The terminal skirt portion 44 of the fan shaped body 32 is shown as terminating in the intake opening 30 that is applied to the surface to be cleaned.

The dashed lines show the alternative novel internal suction channel 22 within the suction head 20 being of variable or non-uniform cross section across the direction of air flow (arrow 24) having the narrow connecting channel 64 spanning the centerline 46 between the pair of elongated ovoids 60, 62. The alternative novel internal suction channel 22 is thus commensurate with the terminal inlet opening 30 and contiguous with the lips 26, 28 thereof, as discussed herein.

The dashed lines also show the slightly arched upper suction channel portion 48 of the fan shaped channel 22 being formed with the slightly inversely bow curved arch 88 that is smoothly faired into fluid communication with the substantially cylindrical exhaust channel 54 of the tubular conduit 38. As discussed herein and shown here by example and without limitation, the inversely curved arch 88 is substantially commensurate with the slightly inversely arched upper portion 34 of the fan shaped body 32. Additionally, the dashed lines show the base portion 56 of the fan shaped channel 22 formed with the gently curving throat portion 90 leading out of the inversely curved arch 88 of the upper suction channel portion 48 and faring smoothly into the generally straight terminal skirt portion 58 of the base portion 56, as discussed herein. As discussed herein, the curved throat portion 90 of the internal suction channel 22 gently rotates the terminal skirt portion 58 back in the general convex direction of the inversely curved arch 88. The curved throat portion 90 gently rotates the terminal skirt portion 58 about 45 degrees, or in the range of about 30 to 75 degrees, away from the inversely curved arch 88 of the upper suction channel portion 48.

The side view of FIG. 35 also shows the internal airfoil 98 interrupting the alternative novel internal suction channel 22 of variable or non-uniform cross section within its slightly arched upper suction channel portion 48, as discussed herein. The convex leading surface 100 of the internal airfoil 98 is shown as interrupting the upper suction channel portion 48 where it transitions into the curved neck portion 42 leading to the generally straight skirt portion 44 of the wide foot portion 40. As discussed herein, the internal airfoil 98 terminates where its opposing side wall surfaces 102, 104 come together and meet in the smooth joint 106 at the upper apex 52 of the internal suction channel 22 adjacent to its outlet 50.

Figures 36, 37:
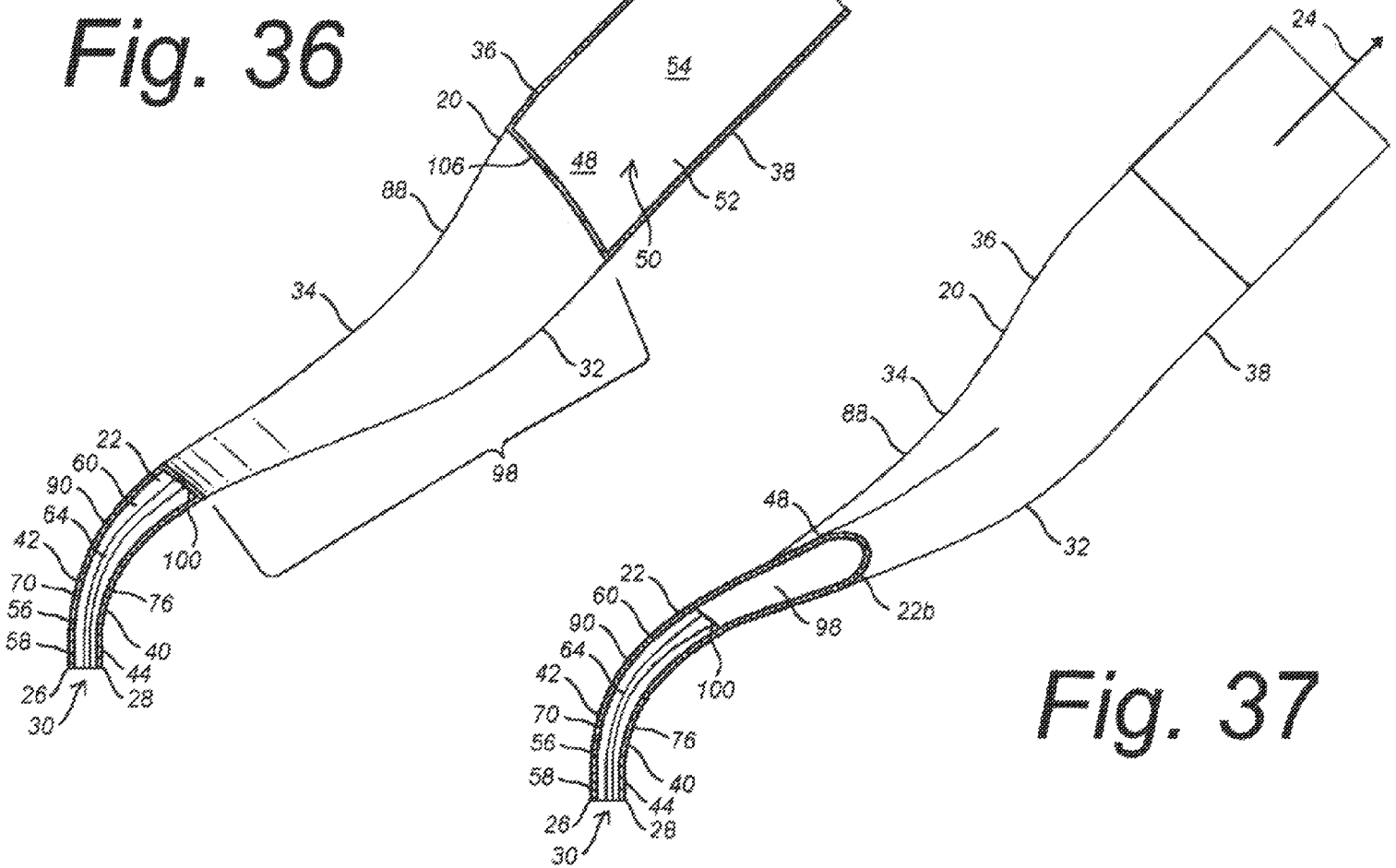

The cross section view of FIG. 36 is taken along the centerline 46 of the alternative novel suction head 20. FIG. 36 shows the narrow connecting channel 64 spanning the centerline 46 and communicating between the pair of elongated ovoids 60, 62 of the non-uniform internal suction channel 22 formed therein and extending into the non-uniform intake opening 30 in fluid communication therewith, as discussed herein.

FIG. 36 also shows the internal airfoil 98 spanning the centerline 46 and interrupting the variable or non-uniform cross section of the internal suction channel 22 formed therein. The internal airfoil 98 is shown as restricted at its leading surface 100 and trailing edge joint 106 to the slightly arched upper suction channel portion 48. The variable or non-uniform cross section of the alternative suction channel 22 thus extends into the intake opening 30 in fluid communication therewith.

The cross section view of FIG. 37 is taken parallel to the centerline 46 of the alternative novel suction head 20 through the nearer one of the pair of elongated oval portions 60, 62 of the non-uniform internal suction channel 22. As illustrated, the general fan shape of the internal suction channel 22 causes the oval portions 60, 62 to taper into the generally tubular shape of the outlet 50 at the upper apex 52 and the crown 36 of the generally fan shaped body 32.

Furthermore, as also illustrated here, the internal airfoil 98 interrupts the arched upper suction channel portion 48 of the non-uniform internal suction channel 22 in the area around the centerline 46 so that the substantially continuous non-uniform cross section of the internal suction channel 22 is divided into the left and right channel portions 22*a*, 22*b*. However, as discussed herein, the internal airfoil 98 is restricted to the area around the centerline 46 so that the general fan shape of the internal suction channel 22 is not interrupted within the left and right channel portions 22*a*, 22*b* of the upper suction channel portion 48 as they extend into the intake opening 30.

Figure 38:
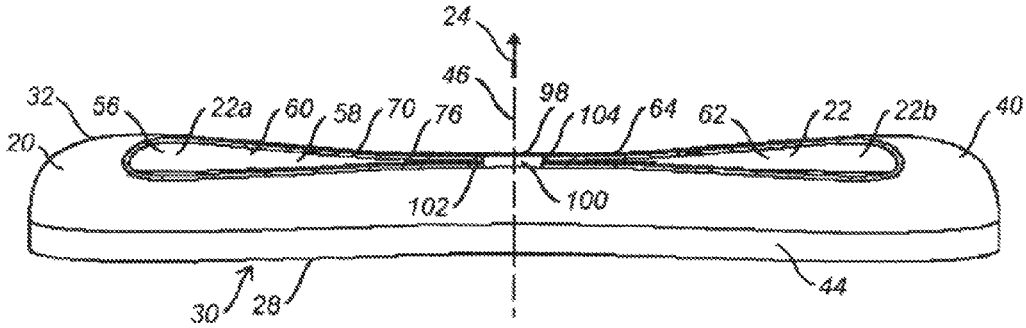

FIG. 38 is a cross section view through the alternative suction head 20 and the alternative non-uniform internal suction channel 22 of FIG. 31 taken transversely of the common centerline 46. Here, the novel double barrel appearance of the internal suction channel 22 is shown to continue from the intake opening 30 in substantial symmetry about the centerline 46 toward its outlet 50 at the upper apex 52.

Furthermore, as also illustrated here, the internal airfoil 98 is shown as interrupting the alternative substantially uniform internal suction channel 22 and dividing the upper suction channel portion 48 into the substantially symmetric left and right channel portions 22*a*, 22*b*. Here, the internal airfoil 98 and left and right channel portions 22*a*, 22*b* are shown to be substantially symmetrical about the centerline 46. The alternative internal suction channel 22 shown here is thus of the substantially continuous non-uniform cross sectional shape extended across the direction of air flow (arrow 24) between the front and back wall surfaces 70, 76 of the internal suction channel 22 and is extended through the lips 26, 28 of intake opening 30, as discussed herein.

While the preferred and additional alternative embodiments of the invention have been illustrated and described, it will be appreciated that various changes can be made therein without departing from the spirit and scope of the invention. Therefore, it will be appreciated that various changes can be made therein without departing from the spirit and scope of the invention. Accordingly, the inventor makes the following claims.

What is claimed is:

1. A suction head, comprising:

a substantially rigid conduit comprising an exhaust channel;

a substantially rigid body comprising a crown portion coupled to the conduit, and an intake opening formed between a pair of spaced apart lips adjacent to a foot portion thereof; and a generally fan shaped suction channel internal of the body and extended between the intake opening thereof and the exhaust channel of the conduit, the suction channel comprising a non-uniform transverse cross section that increases in cross-sectional area substantially symmetrically outwardly from a central portion thereof and fairs smoothly into fluid communication with both the intake opening of the body and the exhaust channel of the conduit, wherein the central portion further comprises a transverse connecting channel smoothly faired between elongated ovoids that increase in area substantially symmetrically outwardly therefrom.

2. The suction head of claim 1 wherein the non-uniform transverse cross section of the internal suction channel further comprises a first pair of surfaces curving outwardly from the transverse connecting channel and smoothly faring into a respective one of the ovoids elongated outwardly therefrom.

3. The suction head of claim 2 wherein the non-uniform transverse cross section is further substantially symmetrical about an axis of the connecting channel oriented substantially transverse of the internal suction channel.

4. The suction head of claim 3 wherein the internal suction channel further comprises a first curved portion adjacent to the exhaust channel of the conduit and in fluid communication therewith and further being partially extended toward the intake opening of the body.

5. The suction head of claim 4 wherein the internal suction channel further comprises a curved throat portion in fluid communication between the first curved portion and the intake opening of the body, the throat portion being curved substantially oppositely of the first curved portion.

6. The suction head of claim 5 wherein the non-uniform transverse cross section further extends substantially through a curved neck portion of the internal suction channel.

7. The suction head of claim 6 wherein the non-uniform transverse cross section further extends substantially through the intake opening of the body.

8. A suction head, comprising:

a substantially rigid suction body portion having extended therefrom a substantially rigid tubular conduit comprising a substantially cylindrical exhaust channel, the body portion comprising:

a crown portion adjacent to the conduit, a wide foot portion opposite from the crown portion and forming a pair of spaced apart lips coextensive with an intake opening thereinto, and a generally fan shaped suction channel formed internal of the body portion and extended between the crown portion thereof and the intake opening, the internal suction channel comprising an upper suction channel portion adjacent to the exhaust channel of the conduit being smoothly faired in fluid communication with the substantially cylindrical exhaust channel thereof, at least a portion of the upper suction channel portion further comprising a non-uniform cross section transverse of a flow path between the intake opening and the exhaust channel and smoothly increasing in spacing between opposing front and back wall surfaces of the upper suction channel outwardly from a central portion thereof;

wherein the internal suction channel further comprises a curved throat portion rotating a portion thereof in fluid communication with the intake opening away from the upper suction channel portion.

9. The suction head of claim 8 wherein the upper suction channel portion further comprises a portion thereof curved substantially oppositely of a curved neck portion.

10. The suction head of claim 9 wherein the non-uniform cross section is further extended substantially adjacent to the intake opening.

11. A suction head, comprising:

a substantially rigid tubular conduit comprising a substantially cylindrical exhaust channel formed therethrough;

a substantially rigid body extended from the conduit adjacent to one end thereof, the body being generally fan shaped and further comprising:

a crown portion joined to the conduit adjacent to one end of the exhaust channel formed therethrough, a foot portion wider than the crown portion and positioned opposite therefrom, the foot portion comprising a pair of spaced apart front and back walls forming an intake opening thereinto between spaced apart lips formed coextensively therewith, an inversely arched upper body portion substantially smoothly joined to the crown portion opposite from the conduit, and a neck portion curved substantially oppositely of the inversely arched upper body portion and rotating the foot portion away therefrom; and a generally fan shaped suction channel formed internal of the body portion and extended between the crown portion and intake opening thereof, the internal suction channel comprising:

an exhaust outlet within the crown portion of the body, the outlet being formed substantially coextensive with the exhaust channel formed through the conduit and being substantially smoothly faired in fluid communication therewith, an inversely arched upper suction channel portion within the inversely arched upper body portion adjacent to the exhaust channel of the conduit, the inversely arched upper suction channel portion being smoothly faired in fluid communication with the exhaust outlet, and at least a portion of the upper suction channel portion further comprising a non-uniform cross section transverse of a flow path between the intake opening and the outlet and comprising a pair of elongated ovoids interconnected by a connecting channel narrower than the ovoids and continuously conjoined therewith through a first pair of outwardly curving surfaces on a first wall surface of the internal suction channel and a second pair of oppositely outwardly curving surfaces on an opposite second wall surface thereof, a base suction channel portion within the foot portion of the body, the base suction channel portion being smoothly faired in fluid communication with the inversely arched upper suction channel portion opposite from the outlet, and being formed substantially coextensive with the intake opening and being substantially smoothly faired in fluid communication therewith, and a curved throat suction channel portion within the curved neck portion of the body, the curved throat suction channel portion being smoothly faired in fluid communication between the base suction channel portion and the inversely arched upper suction channel portion, and being curved substantially oppositely of the inversely arched upper suction channel portion and rotating the base suction channel portion away therefrom.

12. The suction head of claim 11 wherein the non-uniform cross section is further extended through the curved throat suction channel portion and into the base suction channel portion substantially adjacent to the intake opening.

* * * * *